US009093031B2

(12) United States Patent
Kerofsky et al.

(10) Patent No.: US 9,093,031 B2
(45) Date of Patent: Jul. 28, 2015

(54) OFF AXIS HALO MITIGATION USING SPATIOTEMPORAL DITHER PATTERNS, EACH INDEXED AND ARRANGED ACCORDING TO INDEX PATTERNS WITH DIAGONAL LINES OF CONSTANT INDEX

(75) Inventors: Louis Joseph Kerofsky, Camas, WA (US); Benjamin John Broughton, Abingdon (GB)

(73) Assignee: Sharp Laboratories of America, Inc., Camas, WA (US)

( * ) Notice: Subject to any disclaimer, the term of this patent is extended or adjusted under 35 U.S.C. 154(b) by 516 days.

(21) Appl. No.: 12/790,293

(22) Filed: May 28, 2010

(65) Prior Publication Data

US 2011/0291919 A1 Dec. 1, 2011

(51) Int. Cl.

| | |
|---|---|
| ***G09G 3/34*** | (2006.01) |
| ***G09G 3/20*** | (2006.01) |
| ***G09G 3/36*** | (2006.01) |

(52) U.S. Cl.

CPC ..... *G09G 3/3406* (2013.01); *G09G 3/2055* (2013.01); *G09G 3/3611* (2013.01); *G09G 2320/028* (2013.01); *G09G 2320/0646* (2013.01); *G09G 2360/144* (2013.01)

(58) Field of Classification Search

CPC ..... G09G 3/2051; G09G 3/2055; G09G 3/2044–3/205; G09G 3/2052–3/2054; G09G 3/3614

USPC ..... 345/102, 581–599

See application file for complete search history.

(56) References Cited

U.S. PATENT DOCUMENTS

| | | | | |
|---|---|---|---|---|
| 7,079,214 | B2 | 7/2006 | Shimoshikiryo | |
| 8,305,301 | B1 * | 11/2012 | Wedding et al. | 345/63 |
| 2005/0068344 | A1 * | 3/2005 | Kurumisawa | 345/690 |
| 2005/0068463 | A1 * | 3/2005 | Feng et al. | 348/574 |
| 2005/0185001 | A1 * | 8/2005 | Feng et al. | 345/597 |
| 2006/0061826 | A1 * | 3/2006 | Miyasaka | 358/3.13 |
| 2006/0152501 | A1 * | 7/2006 | Furihata et al. | 345/204 |
| 2008/0272998 | A1 * | 11/2008 | Yano et al. | 345/89 |
| 2009/0015539 | A1 * | 1/2009 | Rumreich et al. | 345/102 |
| 2009/0015601 | A1 * | 1/2009 | Kim | 345/690 |
| 2009/0073185 | A1 * | 3/2009 | Liao | 345/596 |
| 2009/0289883 | A1 * | 11/2009 | Choi | 345/89 |

(Continued)

FOREIGN PATENT DOCUMENTS

| | | | |
|---|---|---|---|
| EP | 2085961 | A1 | 8/2009 |
| JP | 2005-258403 | A | 9/2005 |
| JP | 2008-139569 | A | 6/2006 |

OTHER PUBLICATIONS

International Search Report, PCT/JP2010/071767, filed Nov. 29, 2010, 7 pgs.

*Primary Examiner* — Chanh Nguyen
*Assistant Examiner* — Navin Lingaraju
(74) *Attorney, Agent, or Firm* — Chernoff Vilhauer McClung & Stenzel, LLP

(57) ABSTRACT

A method for modifying an image to be displayed on a display includes receiving an image to be displayed on the display having a backlight and a transmissive panel. A backlight signal is provided to the backlight for causing the backlight to selectively illuminate different portions of the backlight with different characteristics. The characteristics include at least one of a different color and a difference luminance. A panel signal is provided to the panel for causing the transmissive panel to selectively change its transmittivities. At least one of the backlight signal and the panel signal are modified in a manner to reduce off-axis artifacts.

19 Claims, 28 Drawing Sheets

GAMMA DOMAIN TONE SCALES (N=4)

(56) References Cited

U.S. PATENT DOCUMENTS

2010/0156774 A1 6/2010 Broughton
2010/0289833 A1* 11/2010 Budzelaar et al. ..... 345/690
2010/0309298 A1* 12/2010 Muijs et al. ..... 348/59
2011/0210912 A1* 9/2011 Jenkins et al. ..... 345/102

* cited by examiner

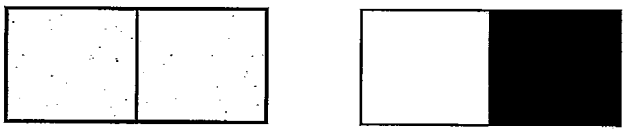
FIG. 13 TWO PAIRS OF PIXELS EACH WITH AVERAGE 50% LUMINANCE

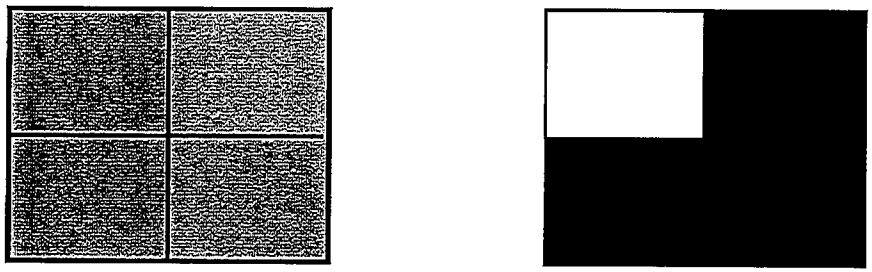
FIG. 14. TWO GROUPS OF FOUR PIXELS WITH AVERAGE 25% LUMINANCE

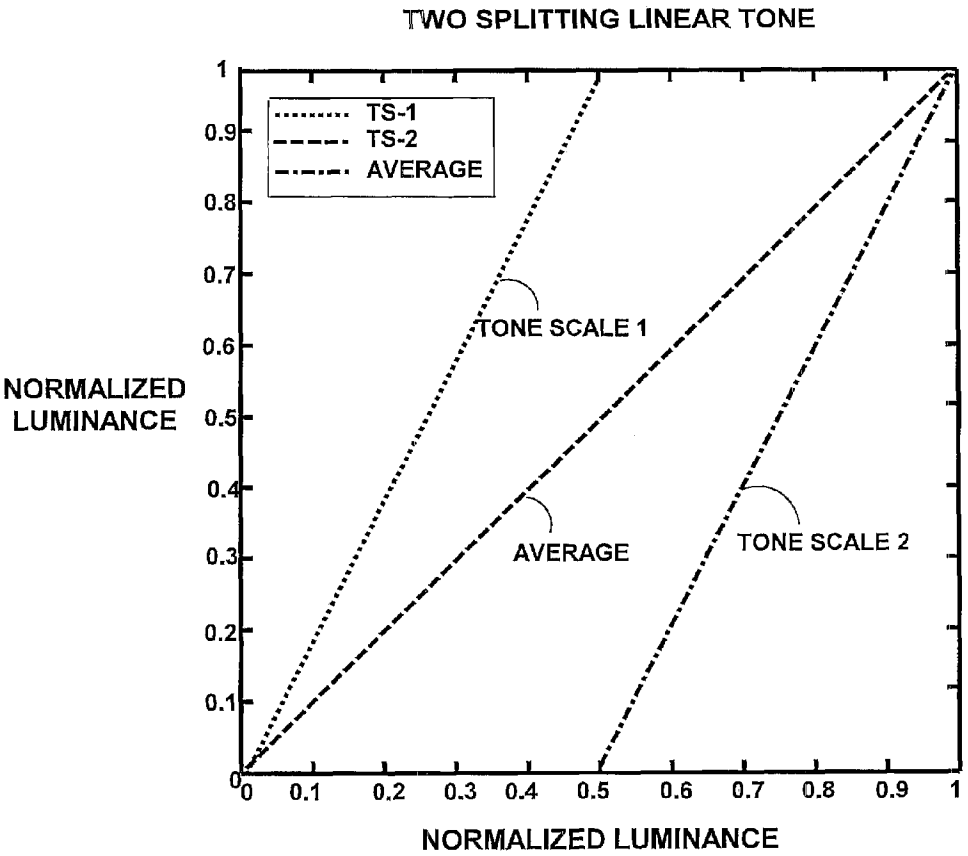
FIG. 15 LINEAR DOMAIN TONE SCALES (N=2)

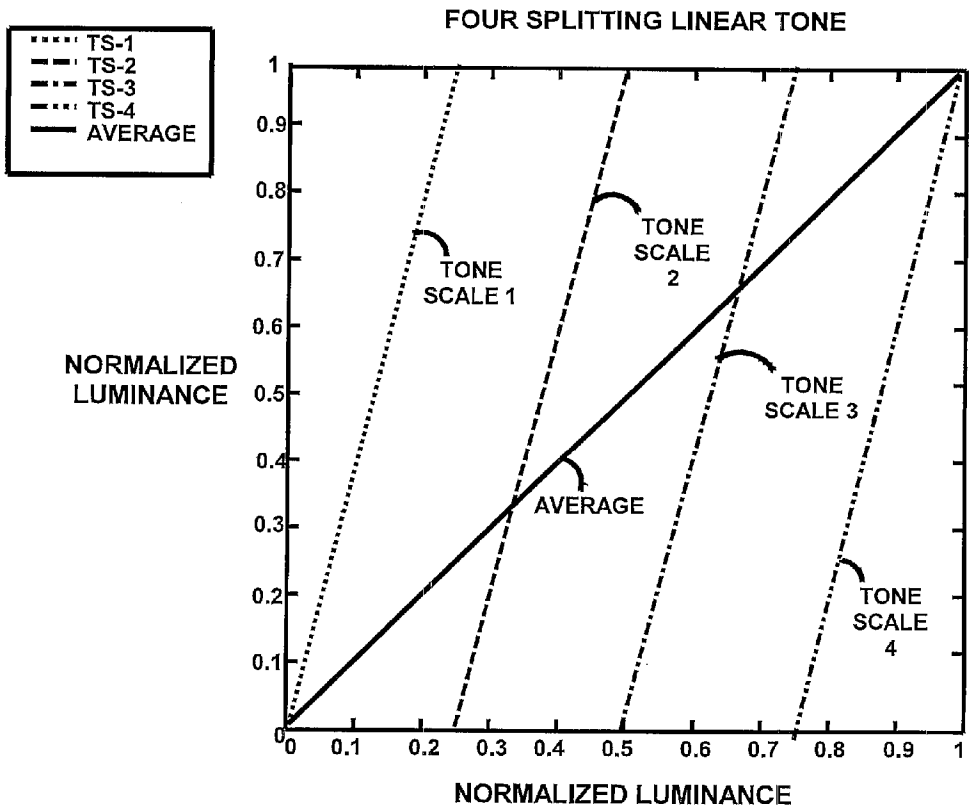
FIG. 16 LINEAR DOMAIN TONE SCALES (N=4)

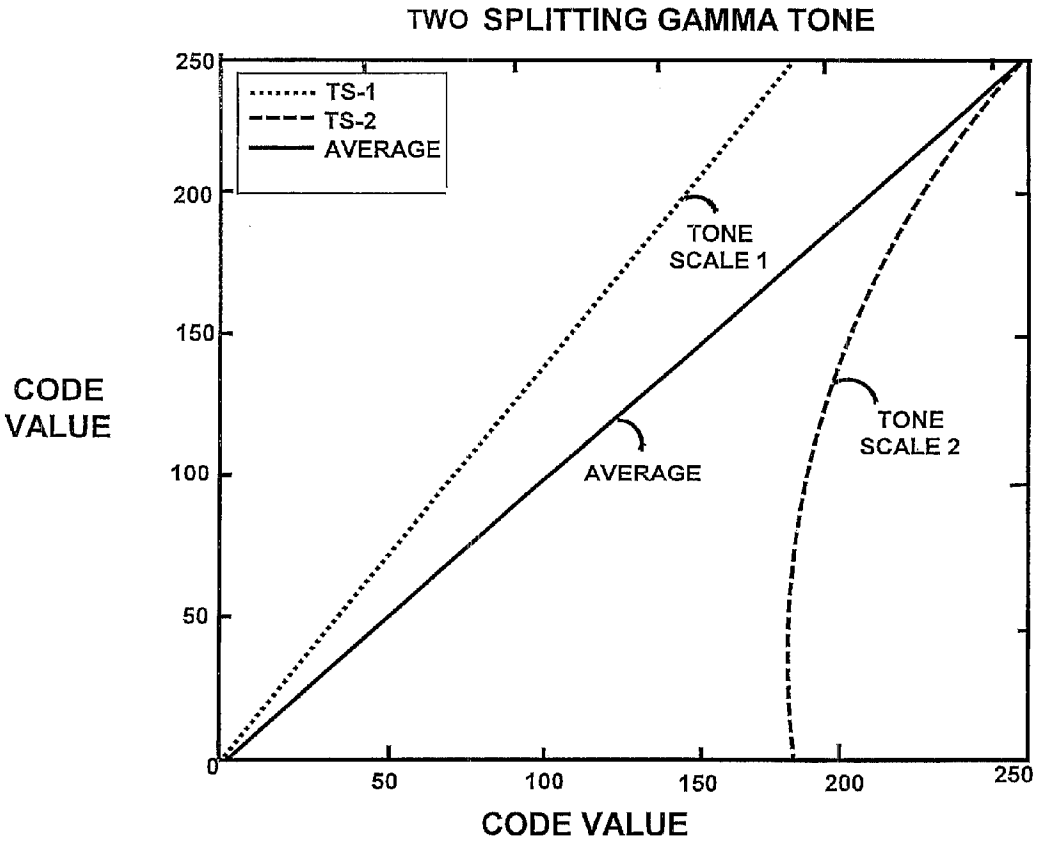
FIG. 17 GAMMA DOMAIN TONE SCALES (N=2)

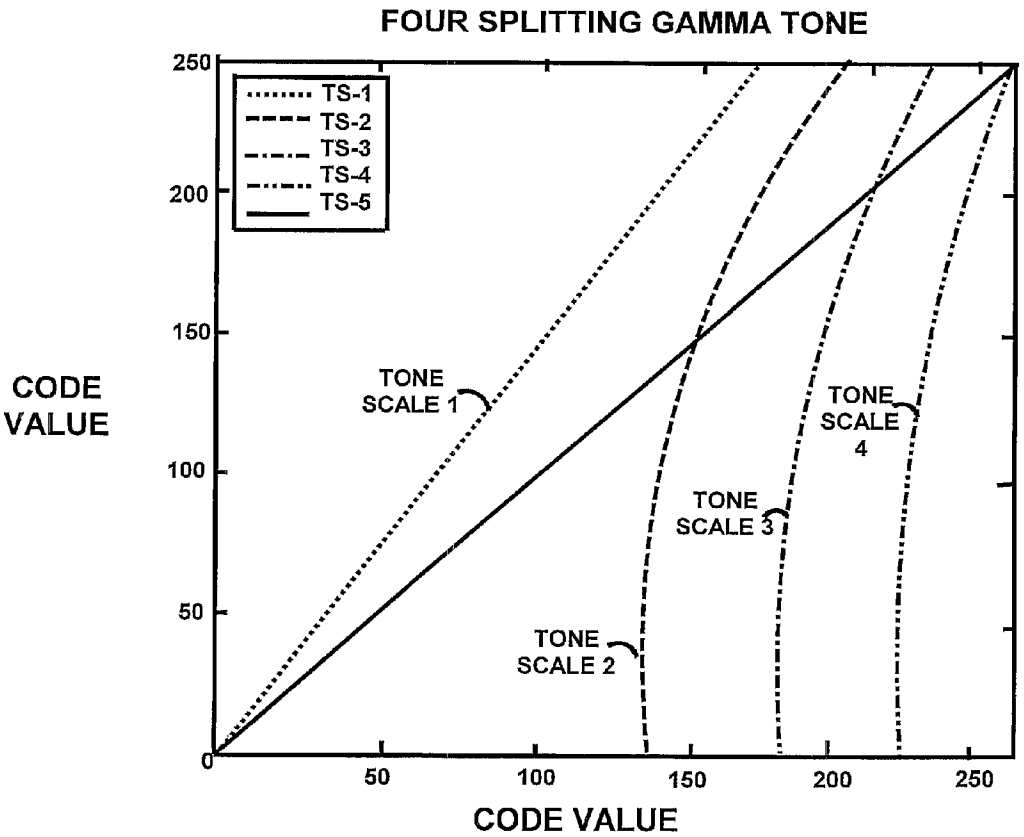
FIG. 18 GAMMA DOMAIN TONE SCALES (N=4)

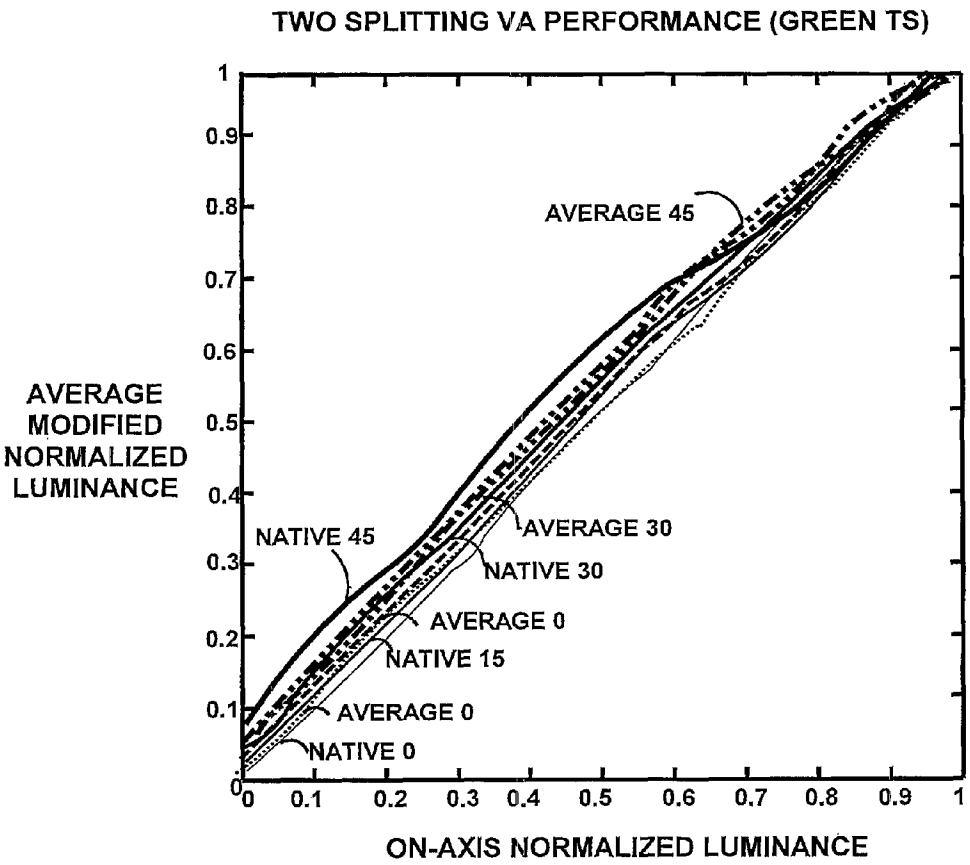
FIG. 19 PERFORMANCE OF TWO PIXEL VIEWING ANGLE MITIGATION

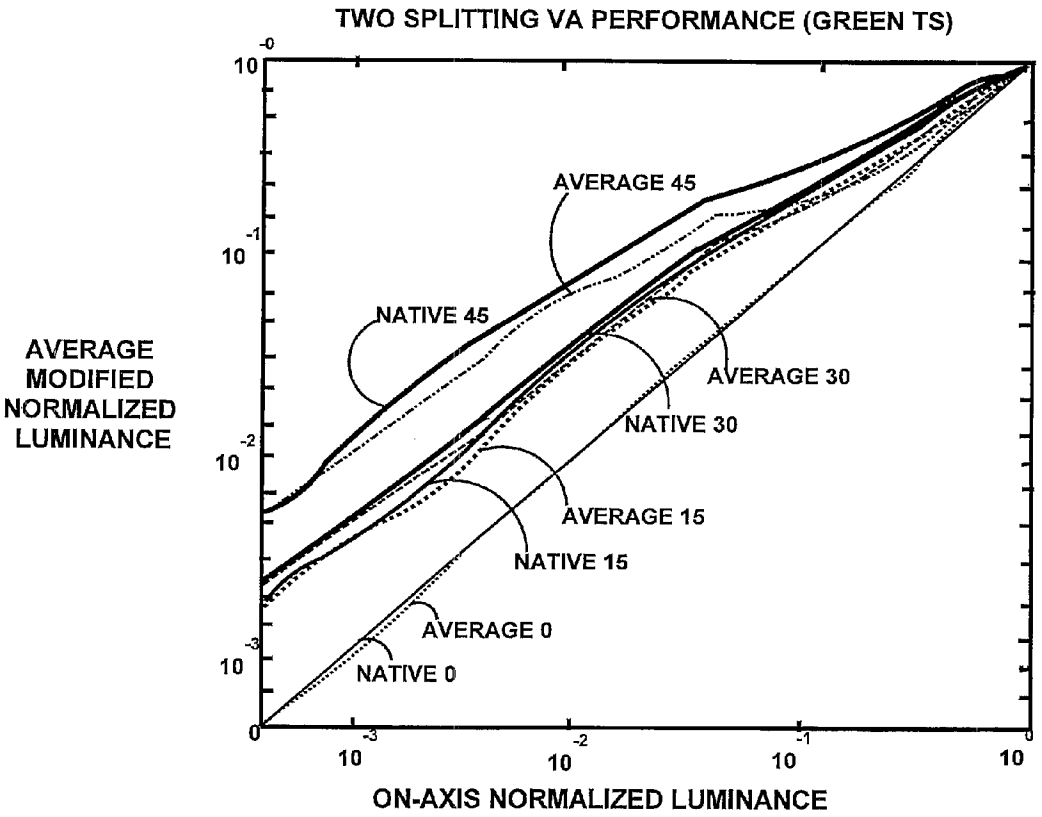
FIG. 20 PERFORMANCE OF TWO PIXEL VIEWING ANGLE MITIGATION LOG-LOG

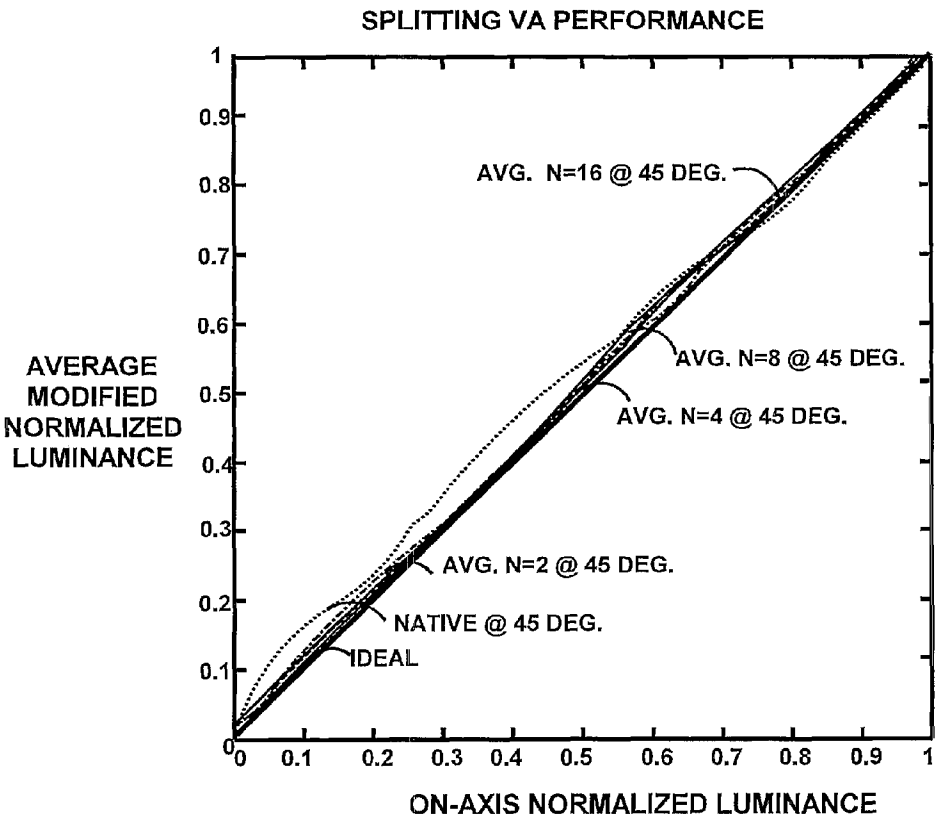
FIG. 21 VIEWING ANGLE PERFORMANCE OF SPLITTING TONE SCALE LINEAR-LINEAR

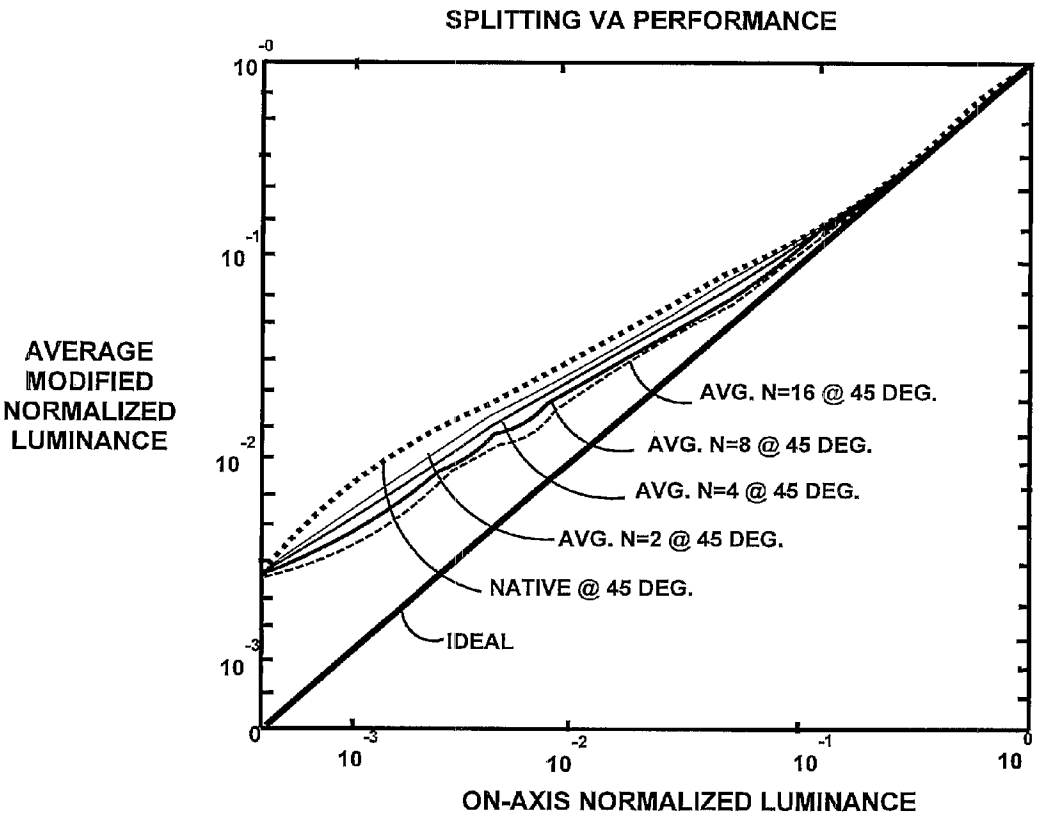
FIG. 22 VIEWING ANGLE PERFORMANCE OF SPLITTING TONE SCALE LOG-LOG

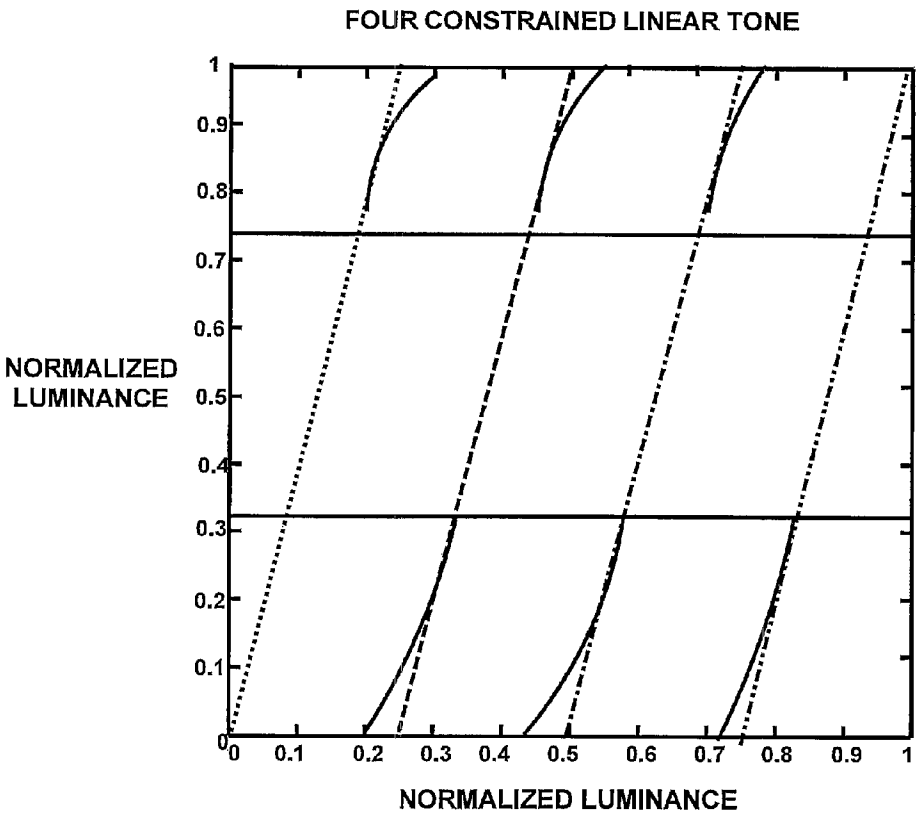
FIG. 23 SLOPE CONSTRAINED SPLITTING TS DESIGN N=4 (LINEAR DOMAIN)

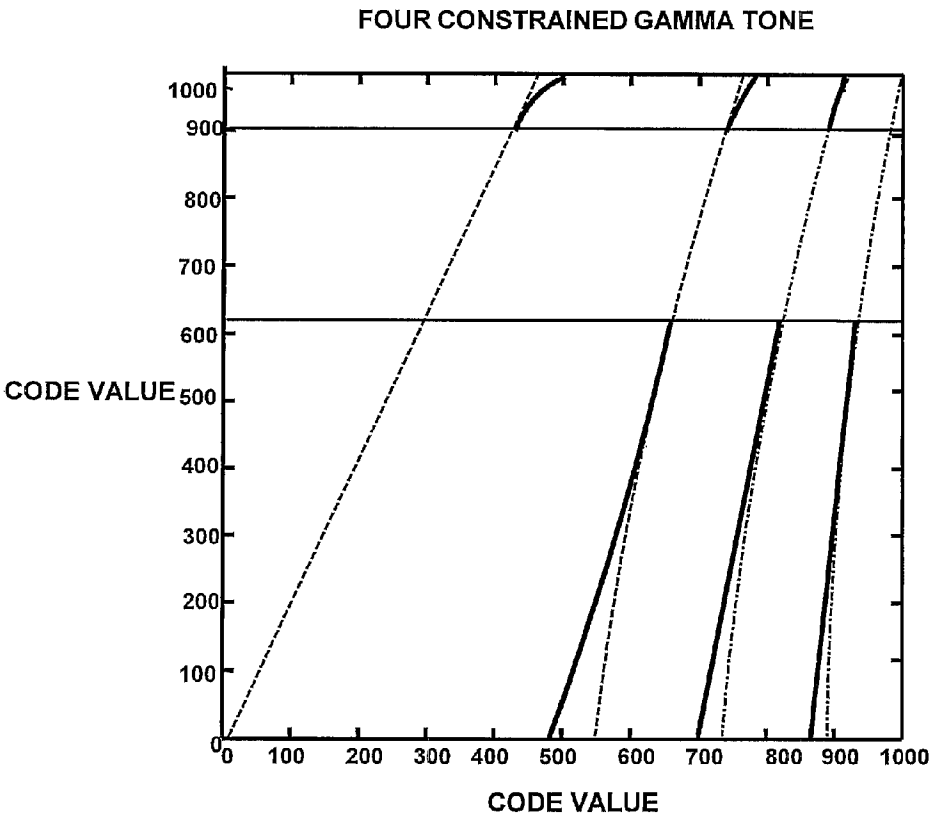
FIG. 24 SLOPE CONSTRAINED SPLITTING TS DESIGN N=4 (GAMMA DOMAIN)

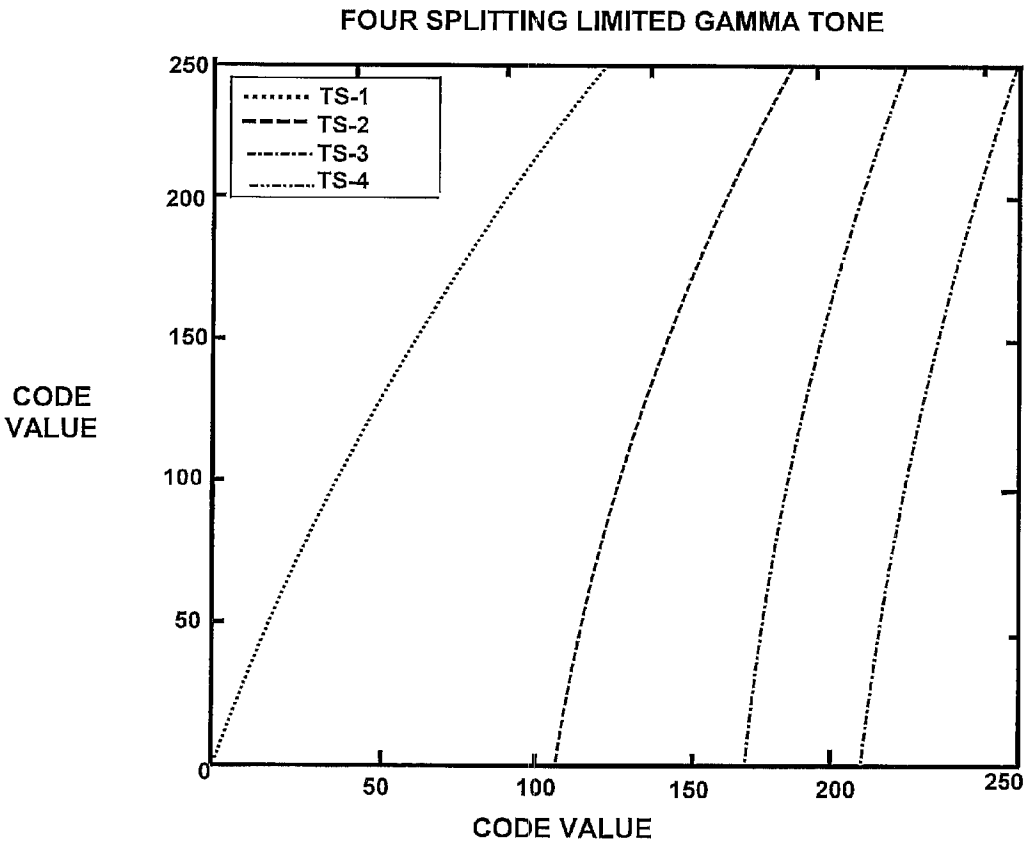
FIG. 25 SLOPE CONSTRAINED SPLITTING TONE SCALE DESIGN (N=4)

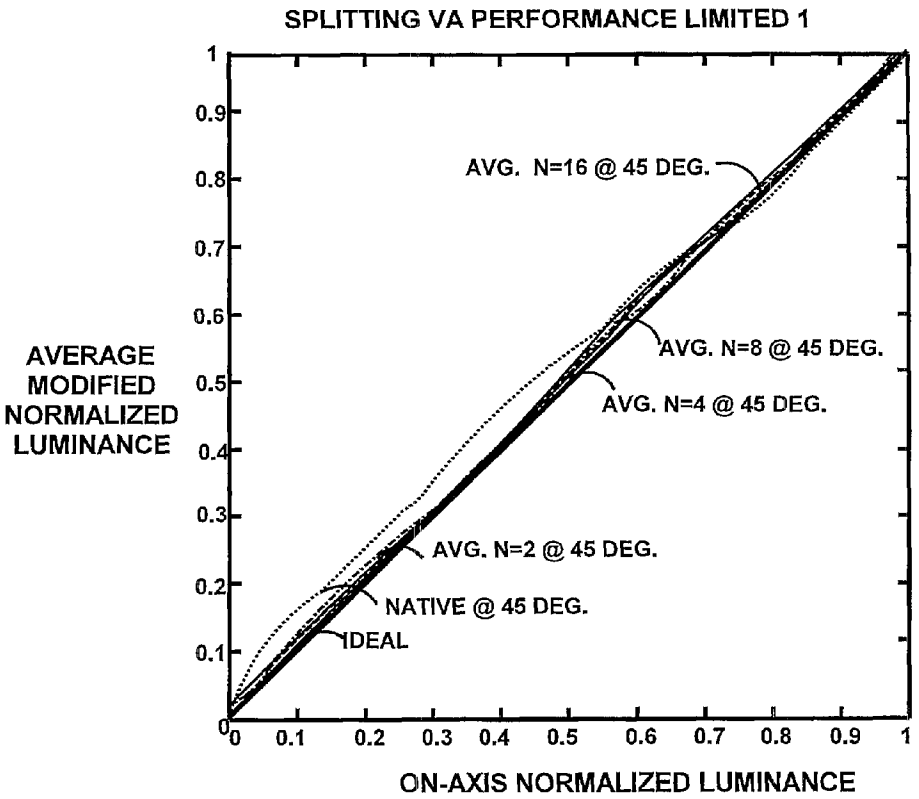
FIG. 26 VIEWING ANGLE IMPROVEMENT OF SLOPE CONSTRAINED SPLITTING DESIGN LINEAR-LINEAR

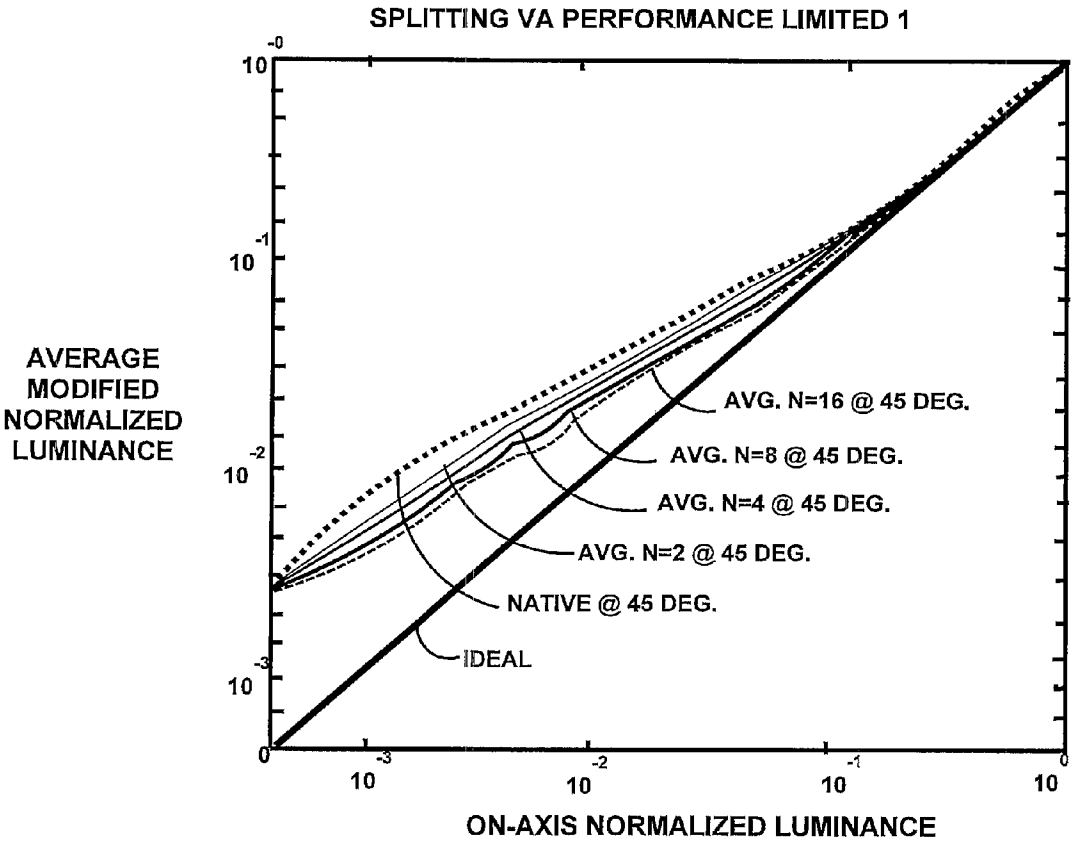
FIG. 27 VIEWING ANGLE IMPROVEMENT OF SLOPE CONSTRAINED SPLITTING DESIGN LOG-LOG

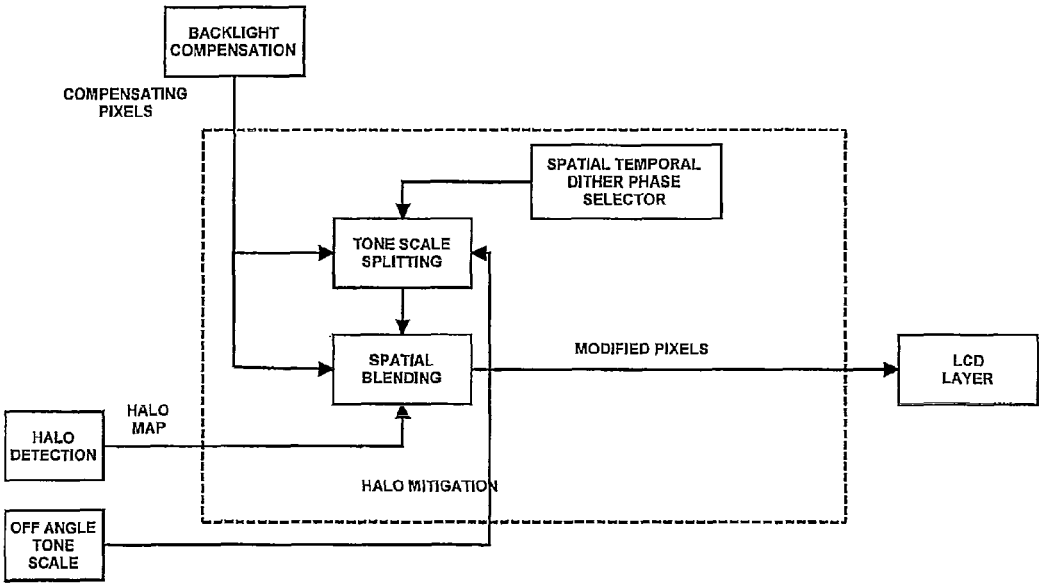
FIG. 28 OFF-AXIS HALO MITIGATION SYSTEM

OFF AXIS HALO MITIGATION USING SPATIOTEMPORAL DITHER PATTERNS, EACH INDEXED AND ARRANGED ACCORDING TO INDEX PATTERNS WITH DIAGONAL LINES OF CONSTANT INDEX

CROSS-REFERENCE TO RELATED APPLICATIONS

Not applicable.

BACKGROUND OF THE INVENTION

The present invention relates generally to decreasing artifacts when a display is viewed off-axis.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to an observer or is blocked, is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transits of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these point or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In a LCD the optical axes of the first and second polarizers are typically arranged at an angle so that light passing through the first polarizer would normally be blocked from passing through the second polarizer in the series. However, a layer of translucent liquid crystals occupies a cell gap separating the two polarizers. The physical orientation of the molecules of liquid crystal can be controlled and the plane of vibration of light transiting the columns of molecules spanning the layer can be rotated to either align or not align with the optical axes of the polarizers.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel.

To darken a pixel and create an image, a voltage, typically controlled by a thin film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted," and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets," such as medical imaging and graphic arts, may demand an even greater dynamic range than available with cathode tube backlight based LCDs.

Another type of LCD display construction is to include a light emitting diode based backlight array. Such an array permits the individual selection of the luminance for individual elements of the backlight array. By selective illumination of the individual elements, different regions of the display may be selectively dimmed or otherwise turned off, which increases the dynamic range of the display.

Whatever configuration is used for the liquid crystal display, they generally have somewhat reduced performance when viewed from oblique directions. This reduced performance may manifest itself, for example, as decreased contrast, incorrect color rendering, and increased image artifacts. In many cases, some of these performance reductions are more pronounced at lower luminance levels. Residual light leakage, especially in oblique directions, also tends to limit the contrast range of the display at lower light levels.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 13 illustrates two pairs of pixels.

FIG. 14 illustrates two groups of four pixels.

FIG. 15 illustrates two tone splitting curves in the linear domain.

FIG. 16 illustrates four tone splitting curves in the linear domain.

FIG. 17 illustrates two tone splitting curves in the gamma domain.

FIG. 18 illustrates four tone splitting curves in the gamma domain.

FIG. 19 illustrates performance of two pixel viewing angle mitigation.

FIG. 20 illustrates performance of two pixel viewing angle mitigation log-log.

FIG. 21 illustrates viewing angle performance of splitting tonescale linear-lienar.

FIG. 22 illustrates viewing angle performance of splitting tonescale log-log.

FIG. 23 illustrates slope constrained splitting tonescale gamma domain.

FIG. 24 illustrates slope constrained splitting tonescale linear domain.

FIG. 25 illustrates slope constrained splitting tonescale design.

FIG. 26 illustrates viewing angle slope constrained splitting design linear-linear.

FIG. 27 illustrates viewing angle slope constrained splitting design log-log.

FIG. 28 illustrates off-axis halo mitigation.

DETAILED DESCRIPTION OF PREFERRED EMBODIMENT

Figure 1:
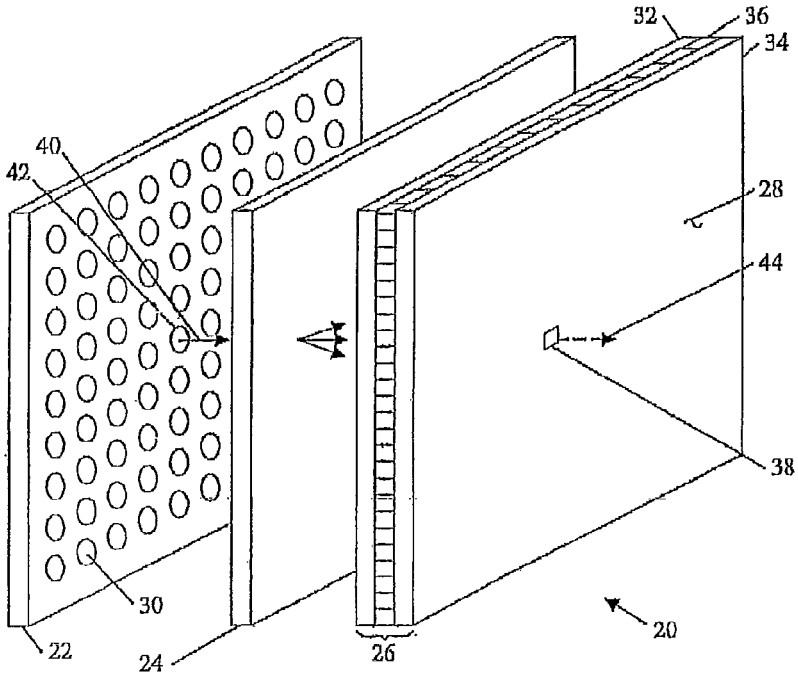
FIG. 1 illustrates a liquid crystal display.

Referring to FIG. 1, a preferred configuration of a liquid crystal display includes a backlit display 20 comprising, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising flourescent light tubes or an array of light sources 30 (e.g., light-emitting diodes (LEDs)), as illustrated in FIG. 1, is used to produce pixels of sufficient intensity for highly visible images or to illuminate the display in poor lighting conditions. There may not be a light source 30 for each pixel of the display and, therefore, the light from the point or line sources is typically dispersed by a diffuser panel 24 so that the lighting of the front surface of the panel 28 is more uniform. In most cases, the density of light sources is substantially less than that of the individual pixels of the liquid crystal layer.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each succeeding molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is "twisted" so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 38 at the front surface of the display 28.

To darken the pixel 38, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to "untwist" the column of molecules so that the plane of vibration of the light is progressively rotated away from the optical axis of the polarizer as the field strength increases and the local transmittance of the light valve 26 is reduced. As the transmittance of the light valve 26 is reduced, the pixel 38 progressively darkens until the maximum extinction of light 40 from the light source 42 is obtained. Color LCD displays are created by varying the intensity of transmitted light for each of a plurality of primary color elements (typically, red, green, and blue) elements making up a display pixel.

In the backlit display 20 with extended dynamic range, the backlight 22 comprises an array of locally controllable light sources 30. The individual light sources 30 of the backlight may be light-emitting diodes (LEDs), an arrangement of phosphors and lenslets, or other suitable light-emitting devices. The individual light sources 30 of the backlight array 22 are independently controllable to output light at a luminance level independent of the luminance level of light output by the other light sources so that a light source can be modulated in response to the luminance of the corresponding image pixel.

A data processing unit may extract the luminance of the display pixel from the pixel data if the image is a color image. For example, the luminance signal can be obtained by a weighted summing of the red, green, and blue (RGB) components of the pixel data (e.g., 0.33R+0.57G+0.11B). If the image is a black and white image, the luminance is directly available from the image data and the extraction step can be omitted. The luminance signal may be low-pass filtered with a filter having parameters determined by the illumination profile of the light source 30 as affected by the diffuser 24 and properties of the human visual system. Following filtering, the signal is subsampled to obtain a light source illumination signal at spatial coordinates corresponding to the light sources 30 of the backlight array 22. As the rasterized image pixel data are sequentially used to drive the display pixels of the LCD light valve 26, the subsampled luminance signal is used to output a power signal to the light source driver to drive the appropriate light source to output a luminance level according a relationship between the luminance of the image pixel and the luminance of the light source. Modulation of the backlight light sources 30 increases the dynamic range of the LCD pixels primarily by attenuating illumination of "darkened" pixels while the luminance of a "fully on" pixel is typically unchanged.

In general, while a liquid crystal display with individually selectable light-emitting elements is preferred, a liquid crystal display with a single adjustable or non-adjustable backlight may likewise be used.

As it may be observed, the transmissive properties of the display, in combination with the intensity of the backlight, determine what is visible from the display. Therefore, the transmittivity of the liquid crystal stack and the luminance of the backlight should be coordinated. If the backlight is dimmed, then the liquid crystal stack should become more transparent in order to maintain the same effective luminance. If the backlight is brightened, then the liquid crystal stack should become less transparent in order to maintain the same effective luminance. In this manner, different backlight intensities along with different corresponding transparencies may be used to achieve a uniform luminance level. Some display characteristics are associated with undesirable attributes, such as artifacts resulting from off-axis gamma distortion. The off-axis gamma distortion may depend on a difference between the perceived color or luminance when viewing the display from an orthogonal viewing direction compared to a perceived color or luminance when viewing the display from an oblique viewing direction. In some cases, the off-axis gamma distortion may manifest itself as a "halo" artifact.

The system may select the colors or luminances based on the content of the image and based on expected selected transmittivities, where the selection of the colors or luminance's is based upon, at least in part, on expected selected transmittivities having a reduced off-axis gamma distortion. In this manner, transmittivities having reduced off-axis gamma distortion may be used to increase image quality.

The colors or luminances may be selected for colors or luminances corresponding to an increased transmittivity of the pixels and/or reduce transmittivity of the pixels. In many displays, and in particular for liquid crystal displays, the off-axis gamma distortion is relatively low toward the maximum transmittivity and the minimum transmittivity. This property may be used to reduce off-axis gamma distortion by selecting the backlight colors or luminances such that an increased transmittivity and/or reduced transmittivity are used, in comparison to what would have otherwise been used.

As described, the tone scale used to compute the driving pixel values generally agrees with the tone scale observed by the viewer of the output image when the display is viewed in an orthogonal direction. However, when the tone scale experienced by the viewer, such as a result of off-axis viewing, differs from the tone scale used to compute the driving pixels, then the image appears to have artifacts. In particular, with local dimming of the LCD, this change in tone scale with viewing angle may also result in visible halos around bright objects on a dim background when viewed off angle. This effect is more pronounced as any of the following factors change, such as, ambient light level decreases, viewing angle increases, and/or image contrast increases.

A LCD with local dimming capability may achieve power savings and high intra-frame contrast by using a backlight capable of spatial area modulation combined with spatial compensation of the image displayed on the liquid crystal layer. The pixel values of the original image are modified based on the selected backlight to determine corresponding transmittivity values. In general, the system divides the desired output image by the backlight to determine the value for the liquid crystal. The signal used to drive the liquid crystal is determined by further using the tone scale of the display. When the tonescale used by the viewer agrees with the tone scale used to compute the driving pixel values, the desired output image is observed. As previously noted, an artifact arises when the tonescale experienced by the viewer differs from the tonescale used to compute the driving pixel values. In this case the driving pixel values do not reproduce the desired output. A display with local backlight dimming may also result in a change in tone scale with viewing angle that results in visible halos around bright objects on dim backgrounds when viewed off-angle. This effect is more pronounced as any of the following factors change: ambient light level decreases, viewing angle increases, and/or image contrast increases.

Figure 2:
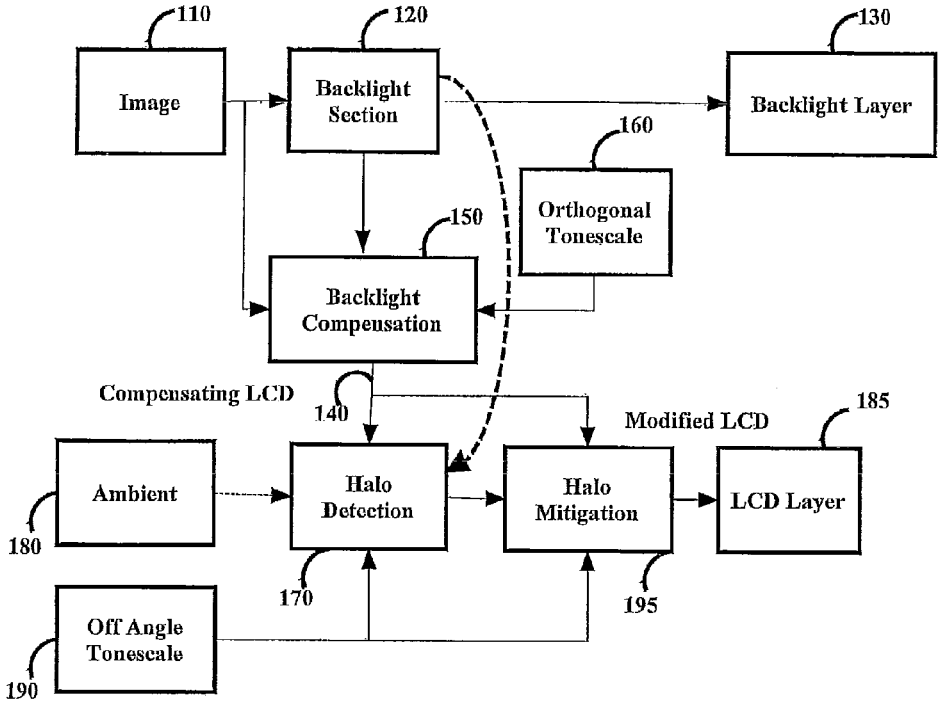
FIG. 2 illustrates a halo reduction architecture.

Referring to FIG. 2, one implementation of an off-axis artifact and reduction technique is a halo mitigation technique. The strength of the applied correction for a region is based upon a measure of the halo visibility in the region of the image. This avoid otherwise introducing artifacts into areas not containing sufficient halo artifacts while simultaneously permitting a strong halo mitigation technique to be applied to regions containing sufficient halos.

An input image 110 is received. A set of backlight values 120 are selected by the system for respective regions of the backlight, which are provided to the backlight layer 130 for illumination. To determine a suitable value for the corresponding LCD layer 140, a backlight compensation 150 is based upon the division of the image 110 by the backlight selection 120, or any other suitable technique. In addition, the backlight compensation 150 may be further based upon an orthogonal tonescale 160 for the display. A halo detection 170 technique may be applied based upon the compensated LCD image 140, and the backlight selection 120 which represents the image 110. Any suitable halo detection technique may be used. In particular, the halo detection technique preferably acts locally on the image so as not to identify regions not having sufficient halo effects. In addition, the halo detection technique may be based upon ambient light levels 180, and/or an off-angle tonescale 190. After halo detection 170 a halo mitigation 195 technique may be used to reduce the visibility of the detected halo. Any suitable halo mitigation technique may be used. In particular, the halo mitigation technique preferably acts locally on the image so as not to mitigate regions not having sufficient halo effects. Based upon the halo mitigation 195, a modified set of data is provided to the LCD layer 185. In general, regional mitigation of off-axis artifacts may be based upon regional areas of the image. Further, the regional mitigation for a particular image of a video is preferably performed by processing the single frame of the video.

Figure 3:
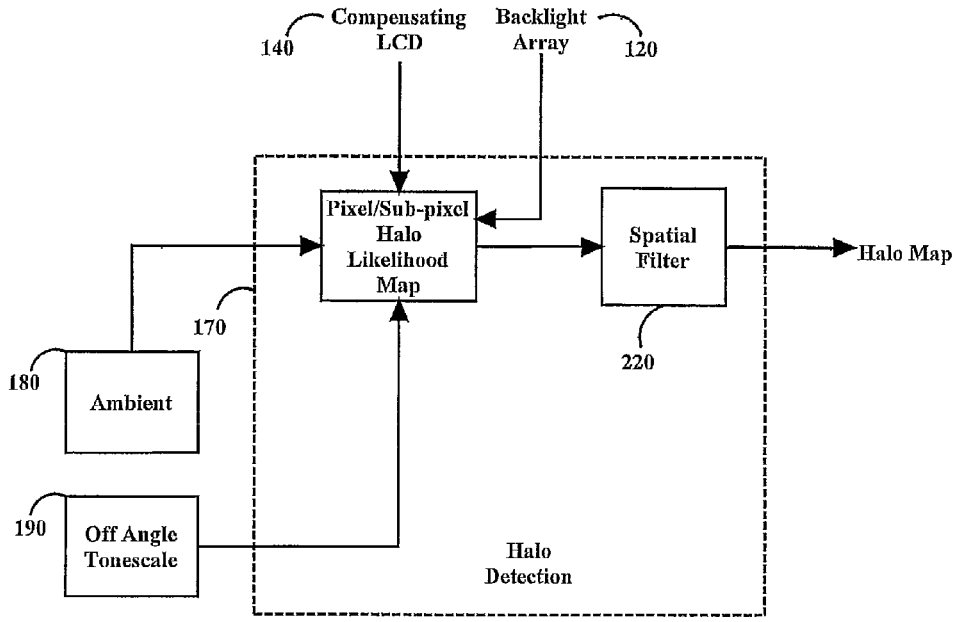
FIG. 3 illustrates a halo detection process.

Referring to FIG. 3, the halo detection 170 may be based upon pixels and/or subpixels contributing to a halo artifact. The halo detection 170 may be spatially filtered 220 to account for the spatial extent of the detected halo, i.e., isolated pixels or small regions may not contribute to identified halo artifacts.

More specifically, a luminance halo generally refers to luminance variation around bright objects when observed over a dark background. Some of the luminance halo is caused by scattering within the optics of the eye and is natural. Halo artifacts occur when a display introduces halos larger than would naturally be seen. In general, these artifacts are more pronounced with the following set of conditions: low ambient light level content, high frequency high contrast image, and/or off angle viewing.

Reduction in halo artifacts may include a compromise in other display attributes, such as intra-frame contrast and power consumption. As an extreme example, halo artifacts are reduced if global backlight modulation, rather than local backlight modulation, is used at the expense of intra-frame contrast and power savings. Also, placing a lower limit on the backlight modulation, the halo artifact is reduced at the expense of elevated black level and increased power consumption.

As illustrated, halo visibility results from tone scale variation when viewing the display off axis. In addition, off axis artifacts and/or halo artifacts may result from a spatial varying backlight and compensating image when viewed off angle, even when the image is flat. For example, a flat image displayed with a spatially varying backlight, together with compensating liquid crystal values, is computed so that the product of the backlight and the liquid crystal image viewed on axis is uniform. The variation in backlight is compensated by variation in the LCD image. When viewed using a different tone scale, i.e. off axis, spatial modulation is seen due to mismatch in the compensation image and the backlight variation. This is primarily a result of differences between the tonescale used to compute the compensation image and the tone scale used to view the image.

The derivation of the image used for backlight compensation is presented in equation 1. Given an image to display, $I_0$, and a backlight signal B(x), the LCD image is $I_1$ computed by division in the linear domain followed by application of the inverse tone scale. The compensating image produces the desired display output when combined with the backlight signal. The calculation of the LCD image depends upon a tone scale to convert a linear light output to a set of driving values for the LCD. In equation 1 below this is denoted by the orthogonal tonescale $T_\perp$.

Equation 1 backlight compensation:

$$Y_\perp(x) = T_{sRGB} \cdot I_0(x)$$

$$Y_\perp(x) = T_\perp \cdot I_1(x) \cdot B(x)$$

$$I_1(x) \equiv T_\perp^{-1} \cdot \left(\frac{Y_\perp(x)}{B(x)}\right)$$

Next a derivation of the image seen when viewed off axis is provided. The image is produced by using the spatial backlight signal B(x), the compensating LCD image $I_1(x)$, and the off angle tonescale. This calculation is summarized in equation 2.

Equation 2 off angle view of compensated image:

$$Y_L(x) = T_L \cdot I_1(x) \cdot B(x)$$

$$Y_L(x) = T_L \cdot T_\perp^{-1}\left(\frac{Y_\perp(x)}{B(x)}\right) \cdot B(x)$$

The error between the perpendicular and off angle images is computed in equation 3. To derive the effect of the error on spatial modulation, the spatial derivative of the display error is calculated in equation 4. The first term of equation 4 is an image gradient term that is proportional to the spatial derivative of the image displayed. The second term of equation 4 is a backlight gradient term that is proportional to the spatial derivative of the backlight signal.

Equation 3 display error (linear domain):

$$Y_\perp(x) - Y_L(x) = Y_\perp(x) - T_L \cdot T_\perp^{-1}\left(\frac{Y_\perp(x)}{B(x)}\right) \cdot B(x)$$

Equation 1 spatial derivative of display error:

$$\Delta = \frac{\partial}{\partial x}(Y_\perp(x) - Y_L(x))$$

$$\Delta = \left(1 - \frac{\partial(T_L \cdot T_\perp^{-1})}{\partial y}\bigg|_{\frac{Y_\perp(x)}{B(x)}}\right)\frac{\partial(Y_\perp(x))}{\partial x} + \left(\frac{\partial(T_L \cdot T_\perp^{-1})}{\partial x}\bigg|_{\frac{Y_\perp(x)}{B(x)}} \cdot \frac{Y_\perp(x)}{B(x)} - T_L \cdot T_\perp^{-1}\left(\frac{Y_\perp(x)}{B(x)}\right)\right) \cdot \frac{\partial B(x)}{\partial x}$$

The image gradient term is proportional to image gradient which has off angle variation due to tone scale change, i.e., zero if no change in off angle tone scale. The backlight gradient term is proportional to backlight spatial gradient. This term does not exist without active area backlight modulation, i.e. zero for global backlight modulation. This error can be nonzero even when the image content is constant. This quantifies the image artifacts and visible spatial halo variations seen off angle, even when the LCD image is flat.

As a result, changes in tone scale can create spatial variation where there is none if there is backlight variation causing the compensated image to contain spatial information. This information is calculated to remove the backlight variation knowing the tone scale. If the tonescale differs from that used for the compensation calculation, the resulting image will contain spatial variation.

Figure 4:
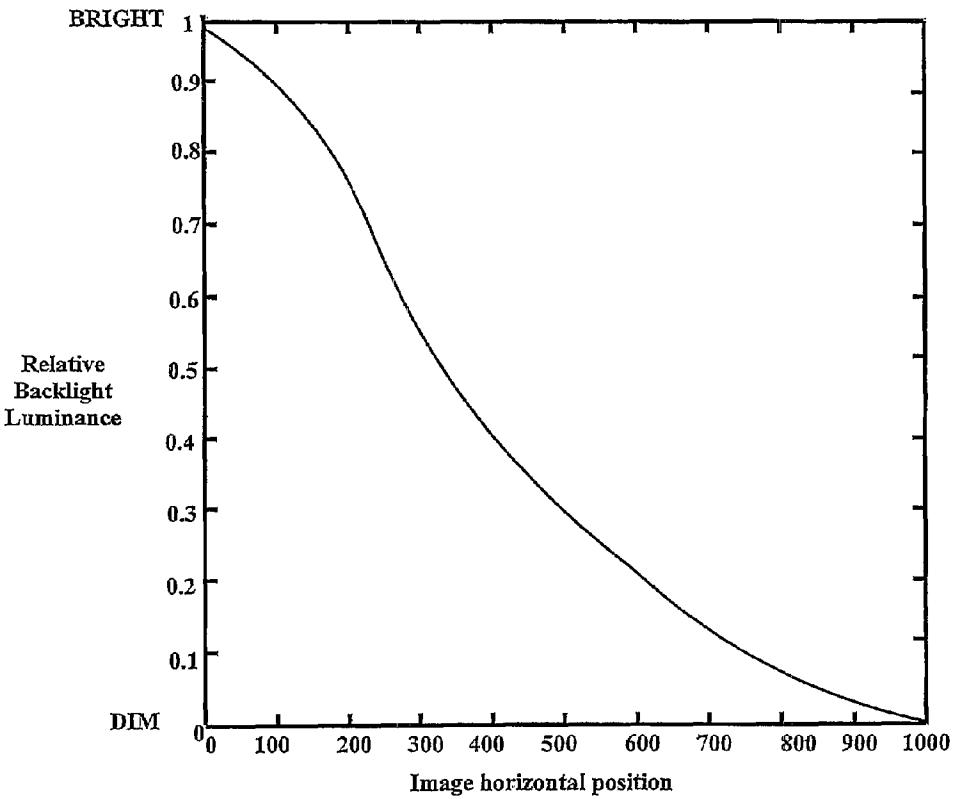
FIG. 4 illustrates spatial backlight variation.
Figure 5:
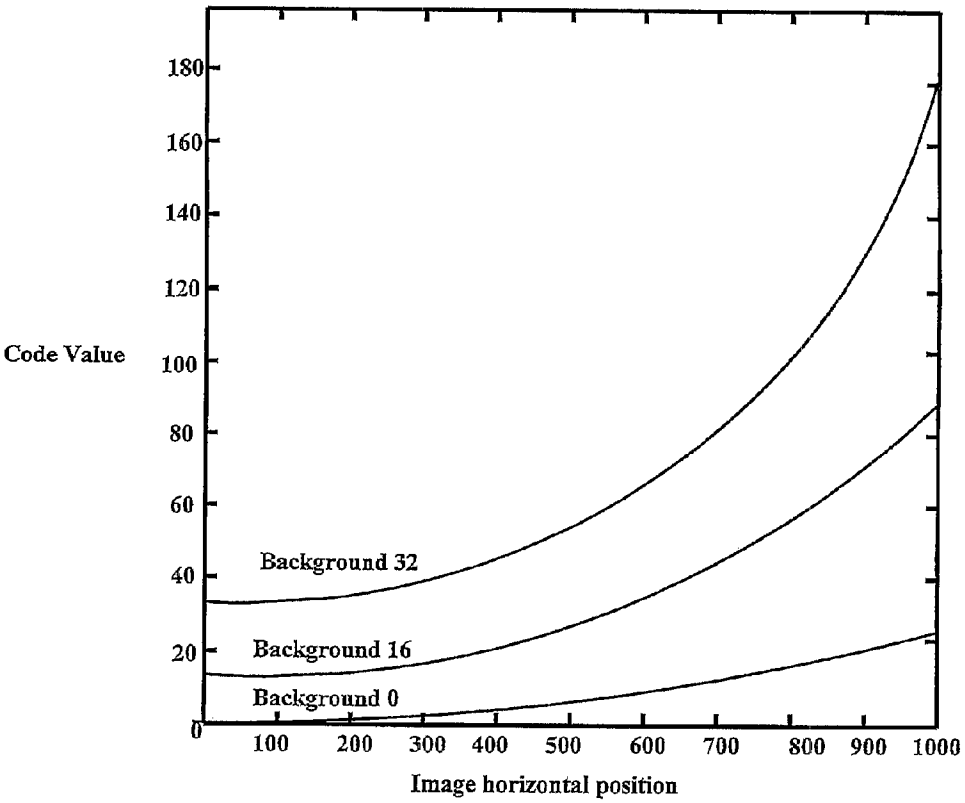
FIG. 5 illustrates compensating code values for three flat images for the spatial backlight variation of FIG. 7.
Figure 6:
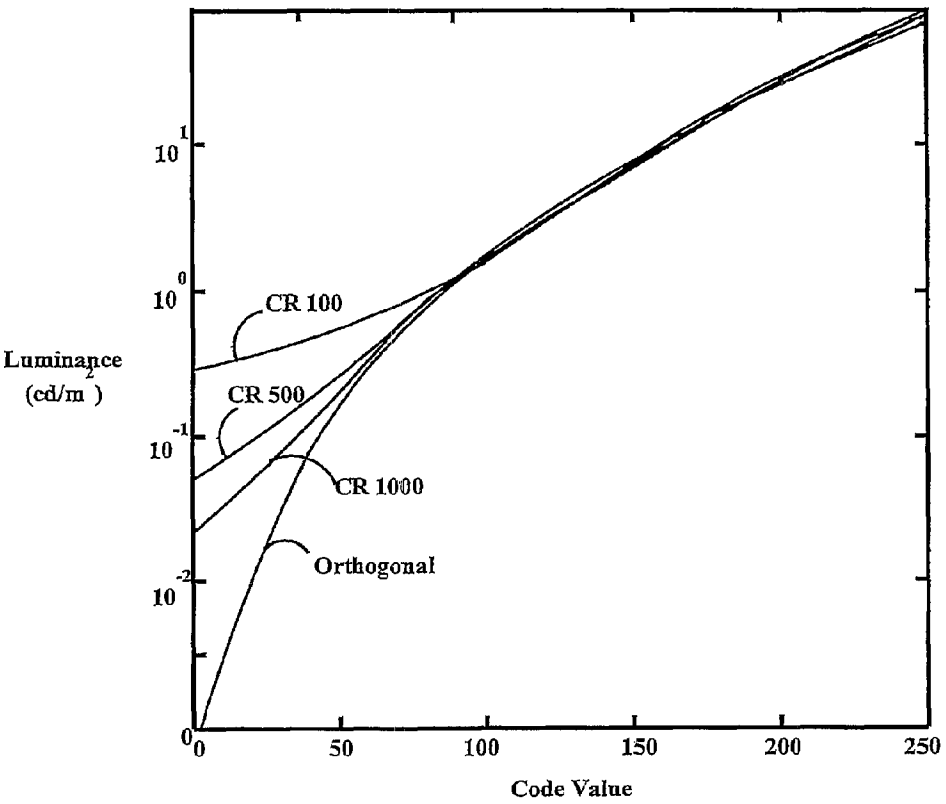
FIG. 6 illustrates tonescale variations.

Referring to FIG. 4, for purposes of illustration, assume a spatially varying backlight and a flat image with constant code value. This is typical of the spread of the backlight due to a highlight into neighboring flat regions. Referring to FIG. 5, a compensating LCD image signal may be determined based upon equation 1 and the spatial backlight signal above. For several flat backgrounds: 0, 16, and 32, the compensating LCD signals are illustrated. Referring to FIG. 6, sample tone scales are illustrated. Below code value 50, the tonescales differ significantly. Thus inaccurate compensation occurs when the compensated image has code values below 50 for horizontal positions less than 600.

Figure 7:
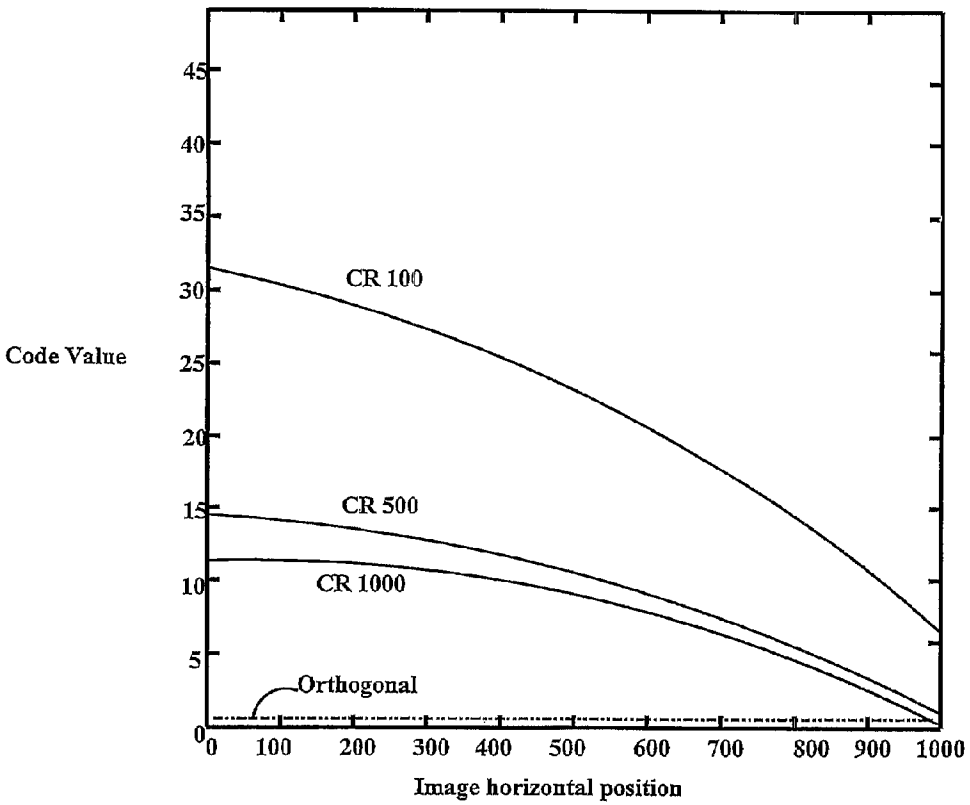
FIG. 7 illustrates the resulting code values for a constant 0 code value for different tonescale variations.
Figure 8:
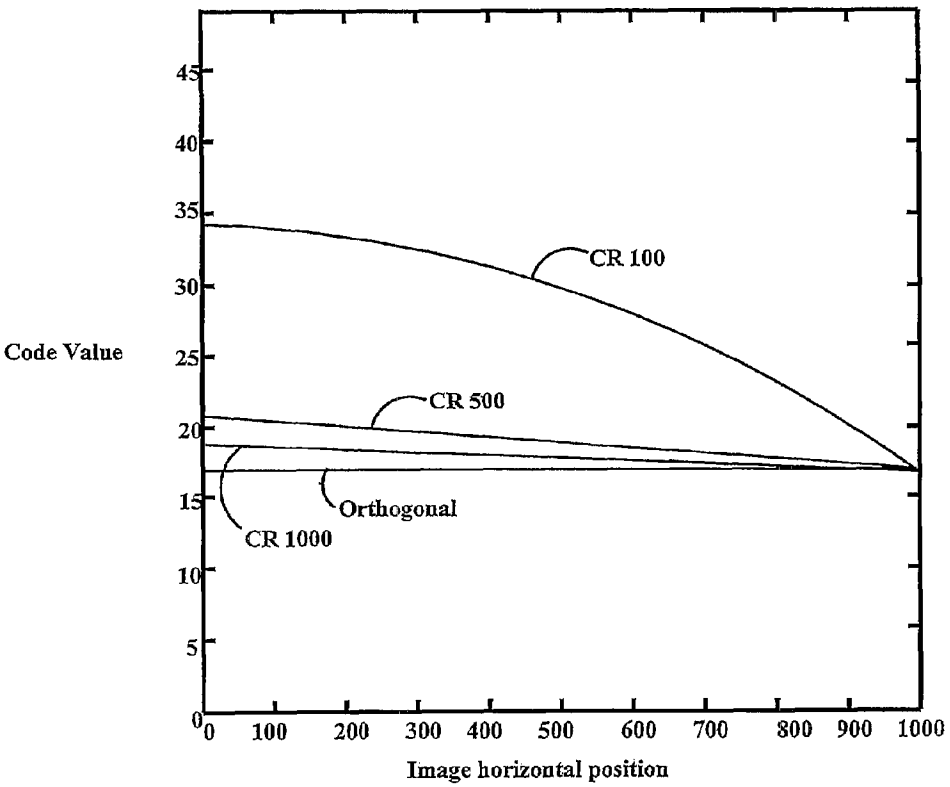
FIG. 8 illustrates the resulting code values for a constant 16 code value for different tonescale variations.
Figure 9:
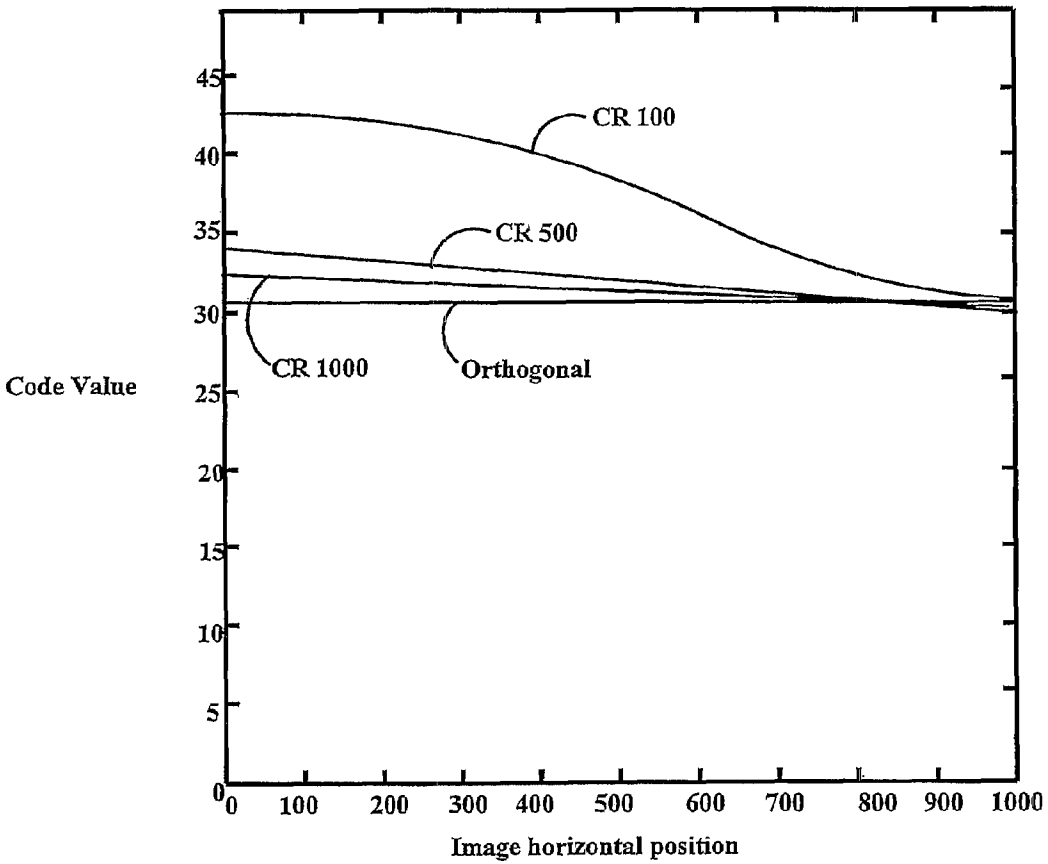
FIG. 9 illustrates the resulting code values for a constant 32 code value for different tonescale variations.

It is useful to compare the orthogonal view which has "perfect compensation" with the image signal emulating a different tone scale to observe the effects. FIG. 7 illustrates different tone scales for a constant zero value (see FIG. 4). FIG. 8 illustrates different tone scales for a constant 16 value (see FIG. 4). FIG. 9 illustrates different tone scales for a constant 32 value (see FIG. 4). In all cases, the orthogonal view is constant and the modulation present in the emulated images is due to a combination of spatial backlight modulation and modulation in the compensating image. These images all show additional brightness in areas where the compensating image has low code values. The effect is more pronounced as the tonescale variation is larger.

Figure 10:
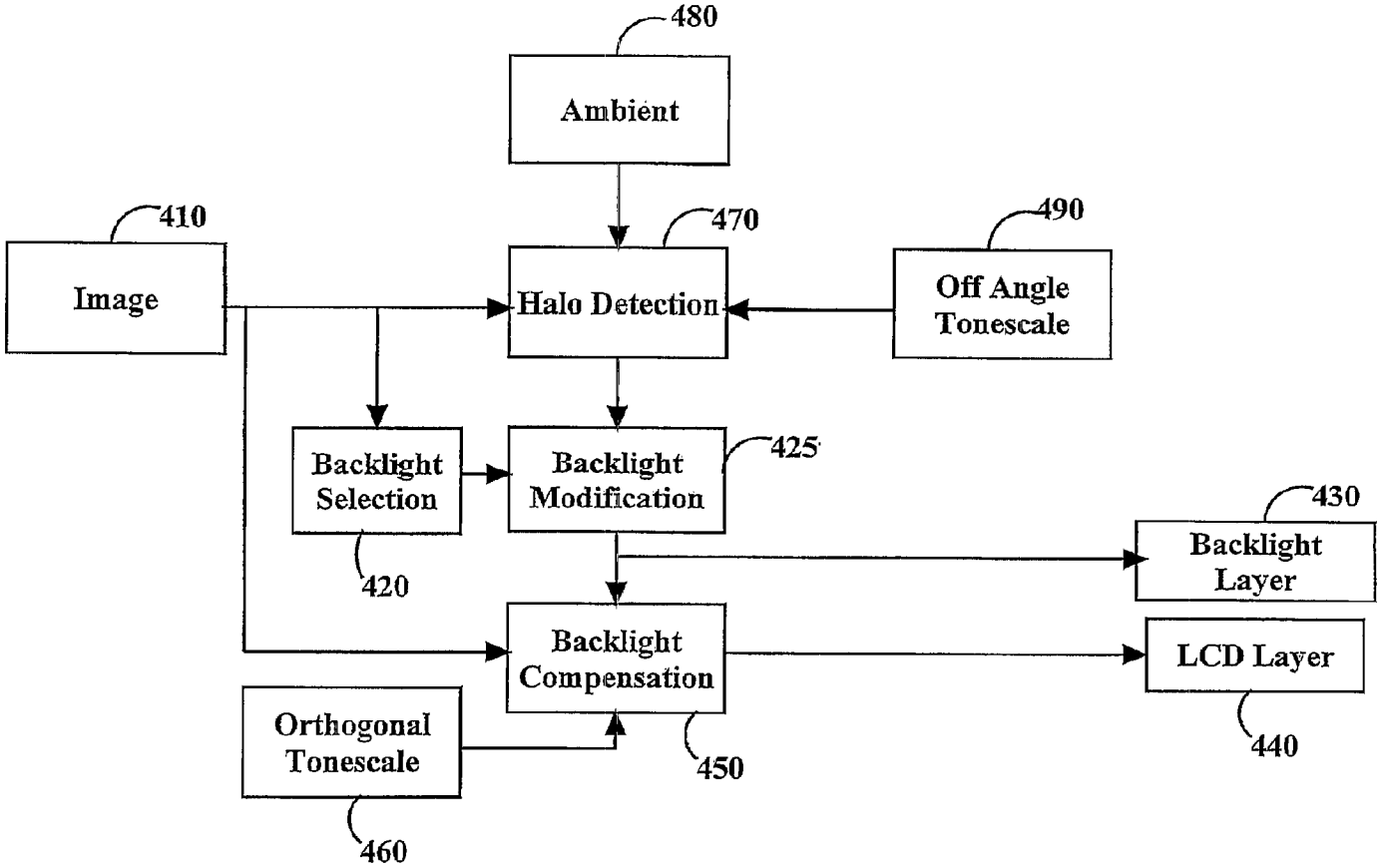
FIG. 10 illustrates another halo reduction architecture.

Referring to FIG. 10, another implementation of an off-axis artifact and reduction technique is a halo mitigation technique. The strength of the applied correction for a region is based upon a measure of the halo visibility in the region of the image. This avoid otherwise introducing artifacts into areas not containing sufficient halo artifacts while simultaneously permitting a strong halo mitigation technique to be applied to regions containing sufficient halos.

An input image 410 is received. A set of backlight values 420 are selected by the system for respective regions of the backlight. A halo detection 470 technique may be applied based upon the input image 410. Any suitable halo detection technique may be used. In particular, the halo detection technique preferably acts locally on the image so as not to identify regions not having sufficient halo effects. In addition, the halo detection 470 technique may be based upon ambient light levels 480, and/or an off-angle tonescale 490. Based upon the halo detection 470 and the backlight selection 420, the backlight is modified 425 to reduce the halo effects. Any suitable backlight modification technique may be used to mitigate halo artifacts. The analysis of the causes of halo artifact indicate reducing high spatial frequency content of the backlight signal. In particular, the backlight modification technique preferably acts locally on the image so as not to mitigate regions not having sufficient halo effects. The data from the backlight modification 425 is provided to the backlight layer 430. To determine a suitable value for the corresponding LCD layer 440, a backlight compensation 450 is based upon the division of the image 410 by the backlight selection 120, or any other suitable technique. In addition, the backlight compensation 150 may be further based upon an orthogonal tonescale 460 for the display. In general, regional mitigation of off-axis artifacts may be based upon regional areas of the image. Further, the regional mitigation for a particular image of a video is preferably performed by processing the single frame of the video.

Figure 11:
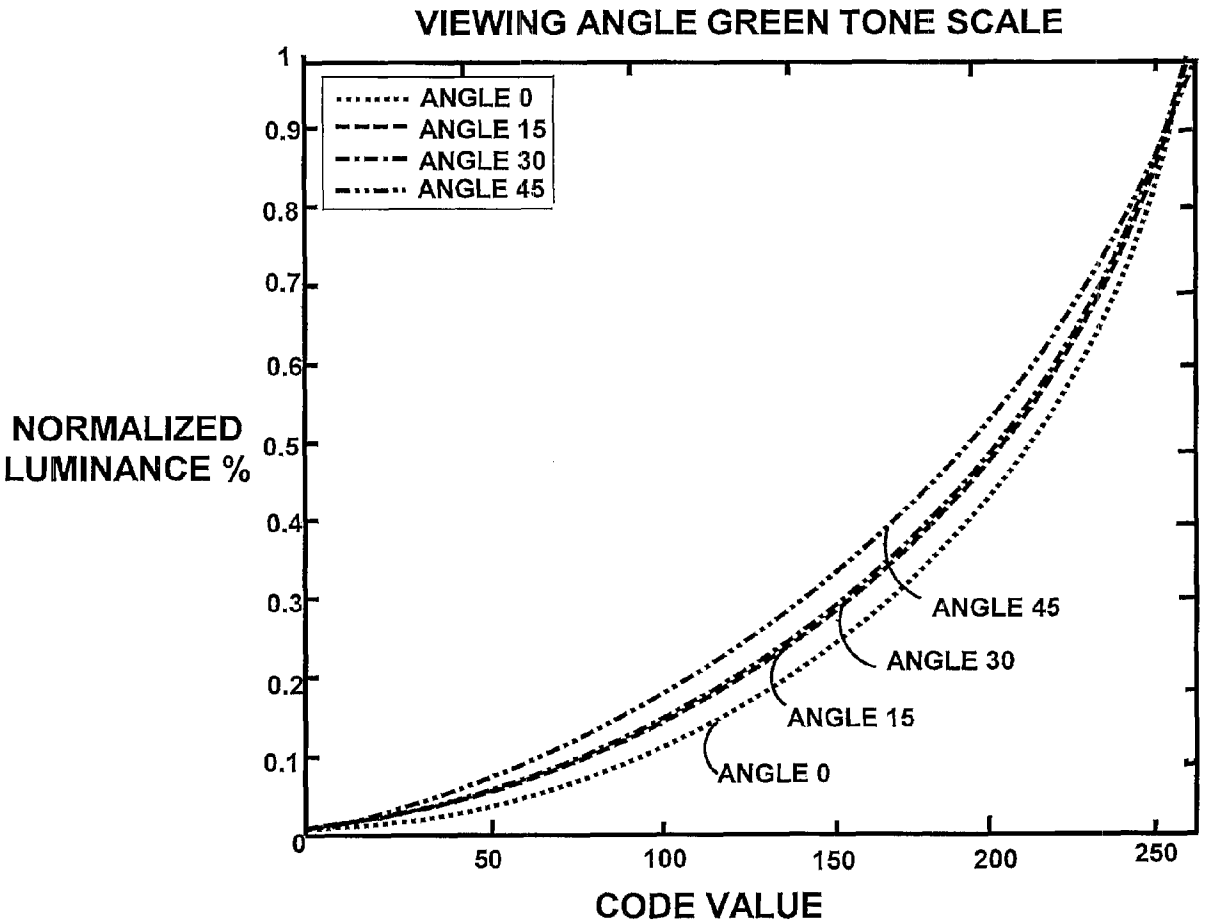
FIG. 11 illustrates normalized luminance versus code value linear domain.
Figure 12:
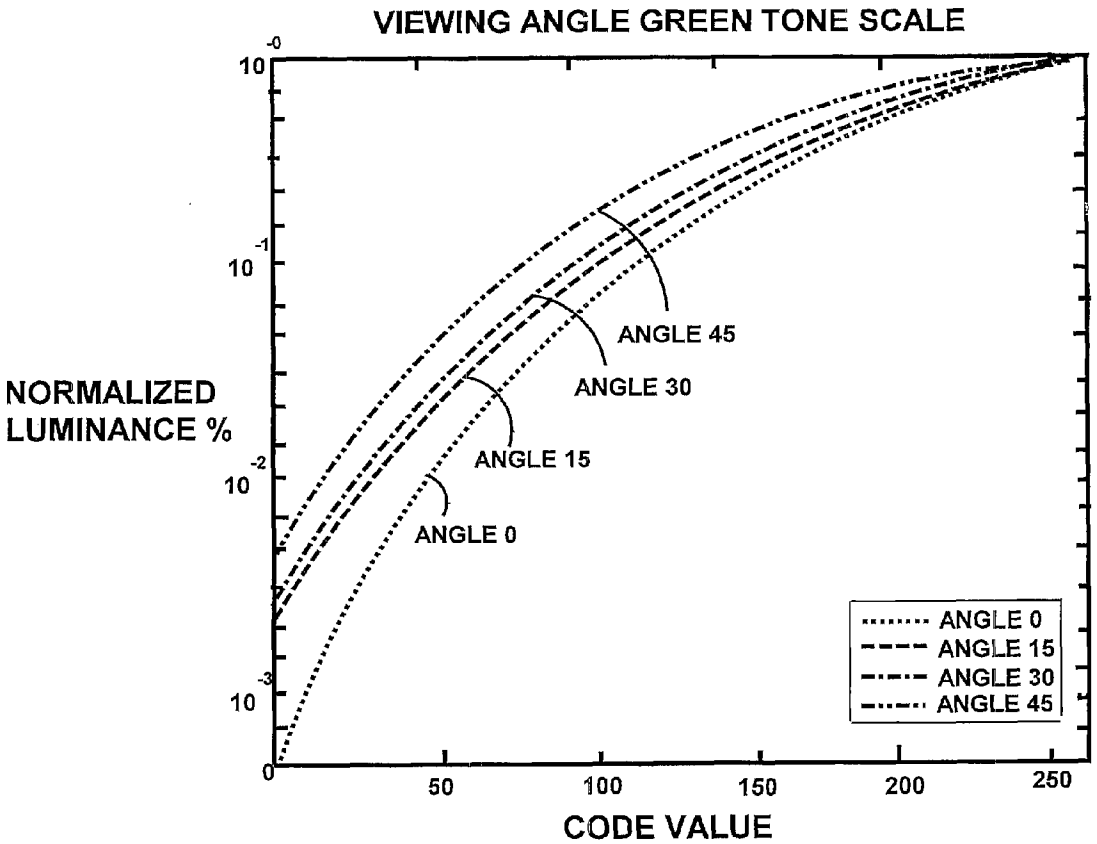
FIG. 12 illustrates normalized luminance versus code value log domain.

Referring to FIG. 11, the viewing angle variation observed in a typical LCD may be characterized by observing a normalized tonescale different code values exhibit different viewing angle performance. Referring to FIG. 12, a plot of the same data using a logarithmic vertical axis is shown. It may be observed that some code values exhibit variation in the normalized luminance as the viewing angle changes. The display maximum does not exhibit significant viewing angle variation while the lower range of code values exhibits sizable deviation from the on-axis performance. The increase in black level at viewing angles off-axis is readily seen in the plots of FIG. 12.

An average of a group of pixels can have reduced angular based artifacts, as a result of off-axis viewing angle, than a single pixel with the same average by tending to use luminance values toward the extremes (e.g., white and black). For clarity the spatial average is described, while it to be understood that the average may likewise be temporal and/or spatial-temporal. Several ways to achieve a medium gray value illustrated in FIG. 13 and FIG. 14. For two pixels, an average of 50% luminance can be achieve with both pixels at 50% luminance, or one pixel at 100% luminance and the other at 0% luminance. Similarly for four pixels, 25% luminance can be achieved with all pixels at 25% luminance, or one pixel at 100% luminance and the three remaining pixels at 0% luminance.

A difference between corresponding pairs, shown in FIGS. 13 and 14, is the viewing angle performance of the average. Since the relative luminance of a full white pixel does not vary much with viewing angle, the average relative luminance of the groups containing the full white pixels varies little with viewing angle. The average relative luminance of groups with a constant gray value varies with viewing angle as illustrated in FIGS. 11 and 12. When representing the average luminance of a group of pixels, using as many "full white" pixels as possible is most robust to viewing angle.

Based upon this spatial based pixel representation, a modified viewing angle mitigation technique is illustrated. A number N is used as a parameter to control the number of intervals to split a tonescale into. N tonescales are preferably selected such that the average of the tonescales in the linear domain is substantially identity. These selected tonescales are then varied spatially and temporally. The individual tonescales of the pixels may be chosen based upon two conditions. First, the average is substantially preserved on-axis meaning the average of the luminance of all the tonescales is substantially equal to the on-axis tonescale. Second, the tonescales are selected to be robust to viewing angle. The maximum code value has zero viewing angle variation from the normalized luminance. Thus the individual tonescales are preferably selected to provide the most full white pixels subject to the average luminance constraint. The tone scales may be any type of representation, such as a look up table or a calculation or a formula.

One technique to improve viewing angle with robust spitting tonescales is to think in the linear domain and consider a block of N pixels each with a different one of the tonescales. Each pixel contributes 1/Nth to the block average. In conventional operation, a constant signal is displayed by using an equal value on each of the N pixels. In a viewing angle mitigation technique the pixels are assigned different values such that the average of N pixels is unchanged but the value for the pixels are not equal. The luminance is divided into N equal (or unequal) intervals. A tone curve goes from minimum to maximum during each interval. These tone curves may be defined in the linear domain as follows.

Equation 5 mth tonecurve of N, piecewise linear:

$$T_m^N(y) = \begin{cases} 0 & y \le \frac{m-1}{N} \\ \left(y - \frac{m-1}{N}\right) \Big/ \left(\frac{m}{N} - \frac{m-1}{N}\right) & \frac{m-1}{N} < y < \frac{m}{N} \\ 1 & \frac{m}{N} \le y \end{cases}$$

Exemplary tone curves for N equal 2 and 4 are shown in FIG. 15 and FIG. 16. Note that the tone curves average to the identity function in both cases. Any point on the average line may be composed of the summation of the values selected by the tone curves. In these examples, only 1 tone curve has a midrange value, with the remaining being fully on or fully off. Other variations may be used with only a limited number of values-having a midrange value, with the remaining values being substantially (or relatively toward the extremes) fully on or fully off.

Construction of the gamma domain tone curves achieving these tone curves may use a gamma transfer function as illustrated in equation 6 below.

$$T_m^N(x) = \begin{cases} 0 & x \le \left(\frac{m-1}{N}\right)^{\frac{1}{\gamma}} \\ (N \cdot x - (m-1))^{\frac{1}{\gamma}} & \left(\frac{m-1}{N}\right)^{\frac{1}{\gamma}} < x < \left(\frac{m}{N}\right)^{\frac{1}{\gamma}} \\ 1 & \left(\frac{m}{N}\right)^{\frac{1}{\gamma}} \le x \end{cases}$$

Plots of the gamma domain tonescales corresponding to the linear domain plots of FIG. 15 and FIG. 16 are illustrated in FIG. 17 and FIG. 18. Note the average is done in the linear domain so simply averaging the two curves is does not accurately represent the tonescale of the group of pixels. The performance the two pixel mitigation techniques is illustrated at various viewing angles is illustrated in FIG. 19 (linear domain) and FIG. 20 (log domain).

Referring to FIG. 21 and FIG. 22, a measured off-axis tonescale @45 degrees was used to evaluate the performance. The normalized luminance resulting from an average of N splitting tonescales is shown for different values of N the number of splitting tonescales. Both linear-linear and log-log plots are illustrated. The ideal line corresponds to zero viewing angle variation. The "Native" line corresponds to the output of the display off-axis without any viewing angle variation mitigation. The following observations may be made:

(A) Splitting the tonescale into N pieces reduces viewing angle variation at the N point 1/N, 2/N, . . . N/N.

(B) The viewing angle variation is generally reduced as the number N increases (C) There is little improvement in the viewing angle dependence of black.

Increasing the number of pixels used for a spatial average or the number of frames used for a temporal average can reduce the viewing angle variation at the expense of reducing the effective spatial or temporal resolution.

This tone scale splitting technique may use several pixels/frames to reproduce the average luminance. Some issues that arise include:

(A) Contouring at points where the splitting tonescale slope is large because the system becomes very sensitive to noise. This contouring can be eliminated for a single viewing angle i.e. on-axis by careful calibration but the viewing angle dependence of the display prevents eliminating the contouring at a range of viewing.

(B) Reduction in effective spatial/temporal resolution of on-axis display. The average over several pixels may be used rather than the pixel values themselves. This impacts both off-axis and on-axis image quality.

(C) The dither pattern may alternate between the splitting tonescales spatially and temporally. This can be classified as a phase dither.

To reduce these limitations the following techniques may be used.

Contouring due to large slope in the splitting tonescale may be addressed by modifying the splitting tonescale design using a slope constrained tonescale design. Reduction in effective spatial/temporal resolution is reduced by applying the off-axis halo mitigation technique only in areas where off-axis artifacts are likely using halo detection and spatial blending of off-axis halo mitigation results. The dithering visibility may be reduced by a combination of spatial and temporal dithering, and construction of reduced visibility dithering patterns, all of which is described below.

The splitting technique is effective at mitigating viewing angle variation. A limitation is the extreme slope of the compensating tonescales in the gamma domain. The gamma domain plots indicate an issue of concern with this design method. The first curve is piecewise linear but the higher curves exhibit a nonlinear variation with very high slope. Analysis indicates that the slope is approaches infinity as the tone curves become active (equation 7). The denominator of the derivative approaches zero as x approaches the first active region of the tonescale.

Equation 7 derivative of splitting tonescale (N, m):

$$\frac{\partial T_m^N}{\partial x}(x) = \begin{cases} 0 & x \le \left(\frac{m-1}{N}\right)^{\frac{1}{\gamma}} \\ N^{\frac{1}{\gamma}} \cdot \left(\frac{1}{1-\left(\frac{m-1}{N}\right)\cdot x^{-\gamma}}\right) & \left(\frac{m-1}{N}\right)^{\frac{1}{\gamma}} < x < \left(\frac{m}{N}\right)^{\frac{1}{\gamma}} \\ 1 & \left(\frac{m}{N}\right)^{\frac{1}{\gamma}} \le x \end{cases}$$

Inaccuracy in measuring the tone curve, particularly isolating individual colors near black, and bit-depth limitations make the denominator detivative a concern. The tone curves have large slopes at different points making the contribution to the average tonescale less dramatic than would be expected from the value of the slope alone. At points where the slope is large, other pixels have zero slope so the average has a relatively modest slope. In fact, when the tone curve exactly matches the tone curve used to construct the splitting, the average tone curve equals the on-axis tone curve. Unfortunately, a slight deviation in tonecurve due to minor viewing angle variation or measurement inaccuracy can result in visible contours.

An improved design will limit the slope of the tonecurves in the gamma domain. The lower segment of the least tone curve is determined by the desired average and that all other tone curves are zero on this lower interval. Similarly, the upper segment of the final tone curve is determined by the average and that all other tone curves are maximal on this upper interval. The lower portion of each tonecurve is preferably linear with a constant slope. The initial design of splitting the luminance equally into N segments where each tone curve is active over a single segment is used. There is no interaction between the tone curves in this maximal splitting design. To reduce the extreme slope observed in the gamma domain, each tone curve may be modified from the initial design on upper and lower regions. Each tone curve is modified in the lower P % of its maximum luminance and the upper Q % of its luminance. The curve is constructed to be linear in the gamma domain on the lower portion. The linear segment is defined by two points. The upper portion of each curve is modified to preserve the average luminance while an adjacent tone curve is modified at its lower range. Examples of this modified design are shown in FIG. 23 and FIG. 24. In this example, the lower ⅓ of the luminance and upper ¼ of the luminance range are modified. The tone curves of the initial design are dashed. It can be seen that the slope issue of the initial design is reduced by the lower end modification. Looking in the linear domain the modification to preserve the average tonescale can be seen in the upper end.

An example of the resulting splitting tonescale design is shown in FIG. 25. The active range of each curve has been extended slightly compared to the previous curve design. The lower ends of these curves are linear, the lower end of the first splitting curve is linear to begin with. The upper ends of these curves are modified to preserve the average tonescale.

Measured tone characteristics may be used to compute the upper and middle regions of each tonecurve where the average constraint applies in the linear domain. This may be done independently per color channel.

The result splitting tone curve design reduces the extreme slope conditions thus avoiding contouring artifacts. While this does not provide complete viewing angle independence at selected points, the viewing angle improvement due to the tonescale splitting is largely preserved, as illustrated in FIG. 26 and FIG. 27.

The resolution reduction caused by dithering may be reduced by applying the off-axis halo mitigation technique in the spatial vicinity of likely off-axis halo artifacts. This may use of an artifact detector and spatial blending to smoothly transition between the original and off-axis halo mitigation images.

Referring to FIG. 28, the halo mitigation modules 195 (see FIG. 2) may receive inputs in the form of an image of compensating pixels, a halo map indicating image regions with off-axis halo artifacts likely, and an off-axis tonescale. The module internally generates a spatial temporal dither phase and includes a set of splitting tonescales based on the off-axis tonescale. The tonescales are applied to the compensating pixels based on the dither phase to produce an off-axis mitigation image. The "Spatial Blending" module uses the halo map to form a weighted combination of the compensating pixels and the pixels of the off-axis mitigation image. The resulting modified pixels are sent to the LC layer of the display.

The mitigation image contains a high spatial frequency whose local average is equal to the original image. To reduce the visibility of this high spatial frequency, the pattern may be varied in space and/or time. The pattern is controlled by an index specifying the splitting tonescale to use. This index may depend upon the spatial location of a pixel, the frame, and/or the color component of a pixel. Spatial variation may be a checkerboard or more complex patterns. When more than 2 phases of splitting tonescale are used the checkerboard pattern is not preferred.

The checkerboard is based on spatial/temporal alternation between two or more tonescales. Within a single frame, the tonescale selected for all subpixels of a pixel is alternated with pixel row and pixel column. The index of the tonescale can be computed from the row and column of the pixel by a modulo 2 sum.

Equation 8 illustrates a single frame tonescale checkerboard:

$$\text{ToneScaleIndex}=1+\text{mod}_2(\text{row}-1+\text{column}-1)$$

This may be extended to include a temporal alternation which swaps the tonescale index each frame. A slight modification of the calculation is shown below.

Equation 9 illustrates temporal dithering with checkerboard:

$$\text{ToneScaleIndex}=1+\text{mod}_2(\text{row}-1+\text{column}-1+\text{frame}-1)$$

This checkerboard may be modified to operate at the subpixel level by replacing the column with the subpixel column in these formulae.

When the tonescale is split into more then two individual tonescale curves, the basic checkerboard is no longer preferred to describe the spatial variation of the tonescale index. The system may decompose the image into square pixel blocks of size N×N. The basic tonescale index construction in the checkerboard case may be generalized into two types:

$$\text{ToneScaleIndex}_+=1+\text{mod}_N(\text{row}-1+\text{column}-1)$$

$$\text{ToneScaleIndex}_-=1+\text{mod}_N(\text{row}-\text{column})$$

Illustrations of the two types of tonescale index constructions for N=3 are illustrated in Table 1 and Table 2.

TABLE 1

| ToneScaleIndex+ | | |
|---|---|---|
| 1 | 2 | 3 |
| 3 | 1 | 2 |
| 2 | 3 | 1 |

TABLE 2

| ToneScaleIndex− | | |
|---|---|---|
| 1 | 2 | 3 |
| 2 | 3 | 1 |
| 3 | 1 | 2 |

Note that the + formula leads to diagonal lines of constant index going down and to the right while the − formula leads to diagonal lines of constant index going up and to the right.

In general, one may define a tonescale index for an entire frame which will alternate the behavior of these two methods on each N×N block by $$\textit{ToneScaleIndex}(\text{row, column}) = 1 + \text{mod}_N\left(\text{row} - 1 + (-1)^{\lfloor \frac{row}{N} \rfloor} \cdot (\text{column} - 1)\right)$$

This pattern is illustrated in the following 9×9 array.

| | | | | | | | | |
|---|---|---|---|---|---|---|---|---|
| 1 | 2 | 3 | 1 | 2 | 3 | 1 | 2 | 3 |
| 2 | 3 | 1 | 2 | 3 | 1 | 2 | 3 | 1 |
| 3 | 1 | 2 | 3 | 1 | 2 | 3 | 1 | 2 |
| 1 | 3 | 2 | 1 | 3 | 2 | 1 | 3 | 2 |
| 2 | 1 | 3 | 2 | 1 | 3 | 2 | 1 | 3 |
| 3 | 2 | 1 | 3 | 2 | 1 | 3 | 2 | 1 |
| 1 | 2 | 3 | 1 | 2 | 3 | 1 | 2 | 3 |
| 2 | 3 | 1 | 2 | 3 | 1 | 2 | 3 | 1 |
| 3 | 1 | 2 | 3 | 1 | 2 | 3 | 1 | 2 |

Extension of this pattern to vary with frame number may be done.

$$\textit{ToneScaleIndex}(\text{row, column}) = 1 + \text{mod}_N\left(\text{row} - 1 + (-1)^{\lfloor \frac{row}{N} \rfloor} \cdot (\text{column} - 1) + (-1)^{(row+column)} \cdot (\text{frame} - 1)\right).$$

For any fixed row and column, the tone scale index cycles through 1 to N giving the temporal average, as desired. Within a single frame, the lines of constant index are broken up by the alternation of sign.

In liquid crystal pixel cells, it is the magnitude of the applied voltage which determines the light transmission (the transmission vs. voltage function is symmetrical about 0V). To prevent polarization (and rapid permanent damage) of the liquid crystal material, the polarity of the cell voltage is reversed on alternate video frames. Unfortunately it is difficult to get exactly the same voltage on the cell in both polarities, so the pixel-cell brightness will tend to flicker to some extent at half the frame-rate. If the polarity of the whole screen were inverted at once then the flicker would be highly objectionable. Instead, it is usual to have the polarity of nearby pixels in anti-phase, thus canceling out the flicker over areas of any significant size. In this way the flicker can be made imperceptible for most "natural" images. Table 3 below illustrates such an arrangement, with RGB subpixels illustrated.

TABLE 3

| | |
|---|---|
| + − + − + − + − + − | + + + + + + + + + + + |
| + − + − + − + − + − | − − − − − − − − − − − |
| − + − + − + − + − + | + + + + + + + + + + + |
| − + − + − + − + − + | − − − − − − − − − − − |
| + − + − + − + − + − | + + + + + + + + + + + |
| + − + − + − + − + − | − − − − − − − − − − − |
| Line-paired RGB sub-pixel dot-inversion pattern | Row inversion (lower power) used eg. on laptops |

The interaction of this inversion process with spatial/temporal dithering may disrupt this alternation of polarity at each subpixel desired to avoid the accumulation of a voltage bias. An example is serves to illustrate the interaction. Fix attention to a single subpixel. The polarity alternates on each frame. Assume temporal alternation among N tonescales. Thus a static pixel value is represented by N possibly distinct levels presented cyclically to the LCD. Due to the inversion process, the voltage will alternate as each level is presented to the display. When N is even, the inversion will repeat over each cycle of N levels. For instance if the first level receives a positive polarity during one frame, the inversion will continue to assign a positive polarity to this level each time it is presented to the display. The splitting tonescale tends to allocate distinct levels to achieve temporal dithering. For example, when N is two, a 50% gray is achieved by using a maximum value 50% of the time and a 0 value for the remaining frames. The maximum values all receive the same polarity blocking the intended alternation of polarity inversion. This behavior is independent of the particularly inversion method used. One way to avoid this interaction is by using an odd number of frames in the temporal dither. Additional methods for configuring the pattern of spatial and temporal dithering may be used so as to prevent interaction with the display inversion pattern.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for modifying an image to be displayed on a display comprising:

(a) receiving an image to be displayed on said display having a backlight and a transmissive panel;

(b) providing a backlight signal to said backlight for causing said backlight to selectively illuminate different portions of said backlight with different characteristics, wherein said characteristics include at least one of a different color and a different luminance;

(c) providing a panel signal to said panel for causing said transmissive panel to selectively change its transmittivities;

(d) wherein at least one of said backlight signal and said panel signal are modified for a group of pixels in such a manner that the spatial resolution of said image is reduced while the intensity value of at least one pixel of said group of pixels is modified using a plurality of different spatiotemporal dither patterns of intensity adjustments, each indexed and arranged over a plurality of pixels according to a plurality of index patterns so to correct for an off-axis artifact, each pattern of intensity adjustments maintaining the same average intensity as the at least one pixel dithered by the respective pattern, each said at least one index pattern having a diagonal line of constant index, and wherein the plurality of index patterns includes at least one pair of index patterns having a reversed polarity with respect to their respective diagonal lines of constant index and each index pattern in the pair alternating polarity temporally over each of a plurality of sequential frames, where the plurality of sequential frames by which said pair of index patterns alternates polarity is limited to an odd number of frames.

2. The method of claim 1 wherein said at least one of said backlight signal and said panel signal are modified in a manner to reduce off-axis halo artifacts in selected regions of said display.

3. The method of claim 1 wherein all but one of said group of pixels is modified to be toward at least one of fully off and fully on.

4. The method of claim 3 wherein said all but one of said group of pixels is at least one of fully off and fully on.

5. The method of claim 1 wherein the alternating said polarity over an odd number of frames mitigates an interaction between a polarity inversion process and said spatiotemporal dither pattern.

6. The method of claim 1 wherein said modification is based upon a changing dither pattern.

7. The method of claim 1 wherein said modification is based upon a decrease in temporal resolution.

8. The method of claim 1 wherein said modification is based upon a plurality of tonescales.

9. The method of claim 8 wherein said tonescales are changed over time.

10. The method of claim 8 wherein a slope of at least one of said tonescales is non-linear.

11. The method of claim 10 wherein said slope is a slope constrained tonescale.

12. The method of claim 1 wherein a portion of said backlight is selectively decreased in illumination while a corresponding portion of said panel is selectively increased in transmittivity to reduce off-axis artifacts.

13. The method of claim 1 wherein a portion of said backlight is selectively increased in illumination while a corresponding portion of said panel is selectively decreased in transmittivity to reduce off-axis artifacts.

14. The method of claim 1 wherein, when said image has uniform luminance values, different portions of said backlight have different luminances while different portions of said panel have different transmittivities so as to provide a substantially uniform image to a viewer observing said display in a perpendicular direction.

15. The method of claim 1 wherein said transmittivity is substantially modified toward maximum transmittivity in regions of a potential off-axis artifact to a greater extent than it would have been without said potential off-axis artifact.

16. The method of claim 1 wherein said modification is based upon a single image and modifies said single image.

17. The method of claim 1 wherein said modification is based upon selected sub-pixels of said display.

18. The method of claim 1 wherein a selected region of said display determined to have sufficient off-axis artifacts are modified to reduce said off-axis artifacts.

19. The method of claim 18 wherein said selected region is based upon a spatial extent of said selected region.

* * * * *